US007934693B2

(12) United States Patent
Bravinski

(10) Patent No.: US 7,934,693 B2
(45) Date of Patent: May 3, 2011

(54) FORMWORK FOR ERECTING REINFORCED CONCRETE WALLS, INCLUDING CONCRETE WALLS WITH TEXTURED SURFACES

(76) Inventor: Leonid G. Bravinski, Toronto (CA)

( * ) Notice: Subject to any disclaimer, the term of this patent is extended or adjusted under 35 U.S.C. 154(b) by 998 days.

(21) Appl. No.: 10/721,945

(22) Filed: Nov. 25, 2003

(65) Prior Publication Data

US 2005/0108985 A1 May 26, 2005

(51) Int. Cl.
*E04G 11/06* (2006.01)
*E04G 17/065* (2006.01)

(52) U.S. Cl. ..... 249/40; 249/216

(58) Field of Classification Search ..... 249/40, 249/41, 42, 43, 190, 213, 214, 216
See application file for complete search history.

(56) References Cited

U.S. PATENT DOCUMENTS 3,199,827 A * 8/1965 Terry ..... 249/41
3,263,956 A * 8/1966 Hawkins ..... 249/40
3,327,988 A * 6/1967 Bridges ..... 249/213
3,601,355 A * 8/1971 Fleck ..... 249/91
4,017,051 A * 4/1977 Scott et al. ..... 249/50
4,234,156 A * 11/1980 Wepf ..... 249/40
4,901,494 A * 2/1990 Miller et al. ..... 249/216
5,209,039 A * 5/1993 Boeshart ..... 249/216
5,497,592 A 3/1996 Boeshart
5,809,725 A 9/1998 Cretti
5,836,126 A * 11/1998 Harkenrider et al. ..... 249/216
5,919,020 A 7/1999 Uli
6,276,104 B1 * 8/2001 Long, Sr. et al. ..... 52/309.4
2003/0177733 A1 * 9/2003 Izquierdo ..... 249/216

OTHER PUBLICATIONS

GRK website "Counter Sinking Screws"; http://www.grkfasteners.com/countersinking_screws.htm; printed Sep. 3, 2003.

* cited by examiner

*Primary Examiner* — Michael Safavi

(57) ABSTRACT

A panel unit used as part of a form for a concrete wall has a pair panels, held in spaced apart relation by a spacer. A spacer has rods with angled rod portions at the end which co-operate with other rod members to form retention cells which can receive reinforcement bar members. Another spacer is prefabricated in a generally planar grid with reinforcement members secured thereto. Connectors are used to connect the spacers to the panels. One type of connector is formed in two parts, with one part being removable, to permit removal of the panel, the other part having an anchoring mechanism. Another connector has a blade element enabling the connector flange to be recessed in the outer surface of the panel. A corner panel unit is also provided, as is a panel unit adapted for forming a wall with a ledge. In other panel units, form liners are provided which can permit a textured or contoured finished wall surface to be produced.

44 Claims, 18 Drawing Sheets

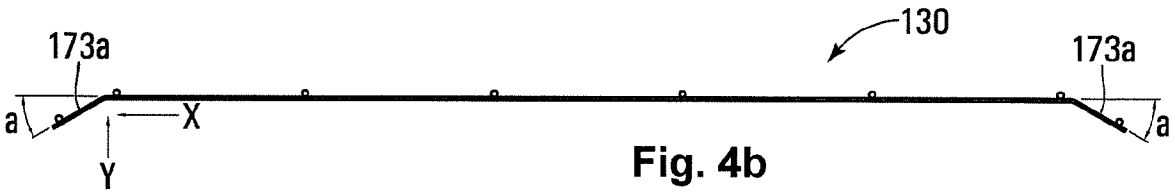
Fig. 4b
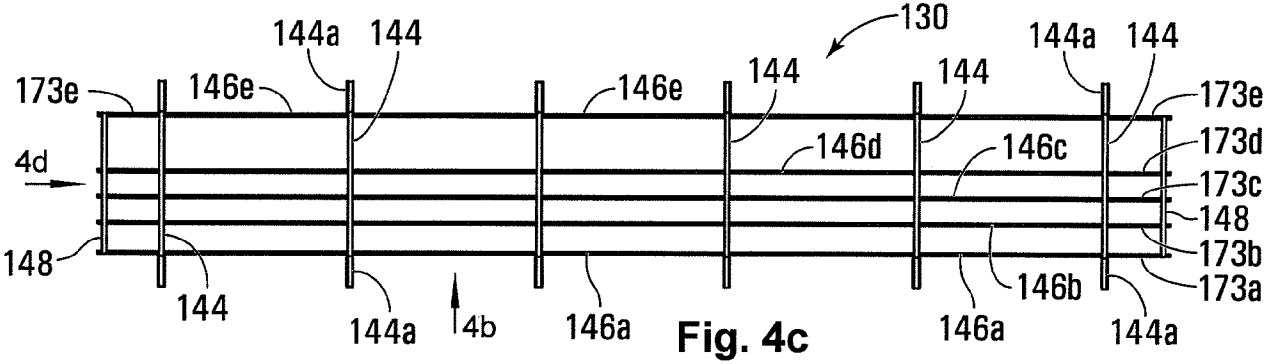
Fig. 4c
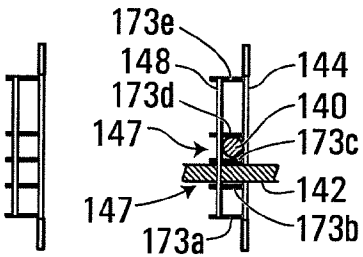
Fig. 4d
Fig. 4e
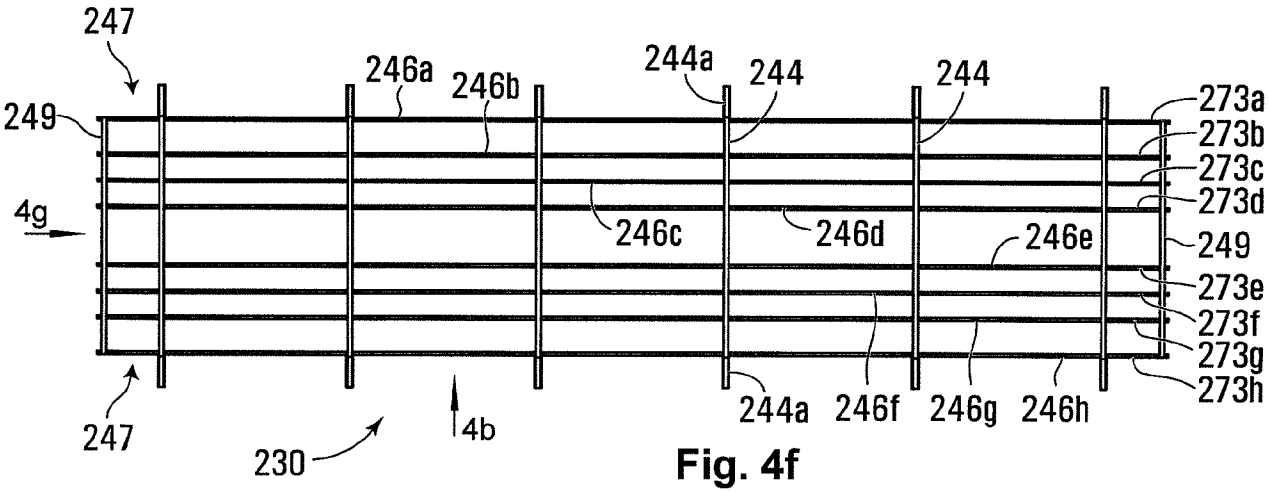
Fig. 4f
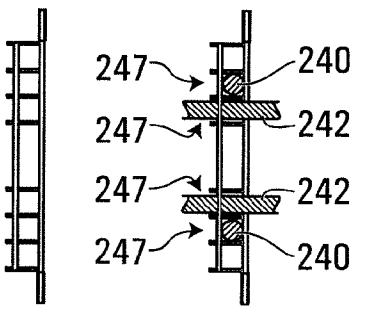
Fig. 4g
Fig. 4h

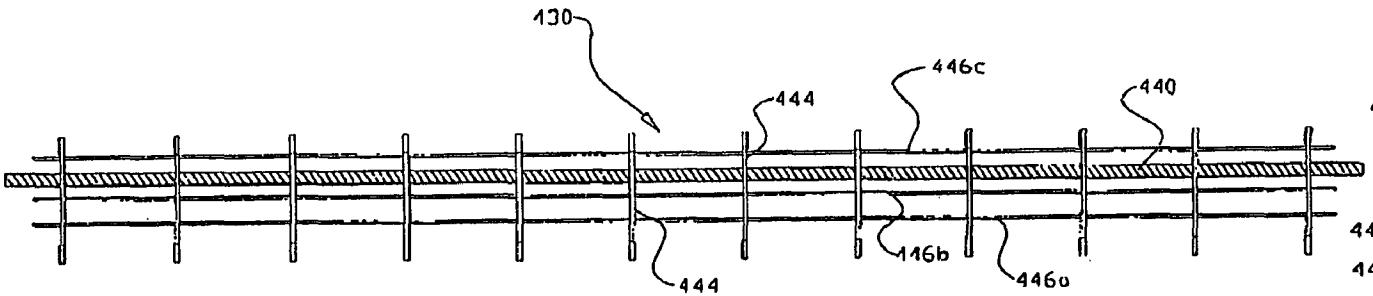
Fig. 5a
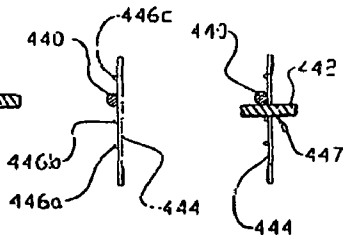
Fig. 5b
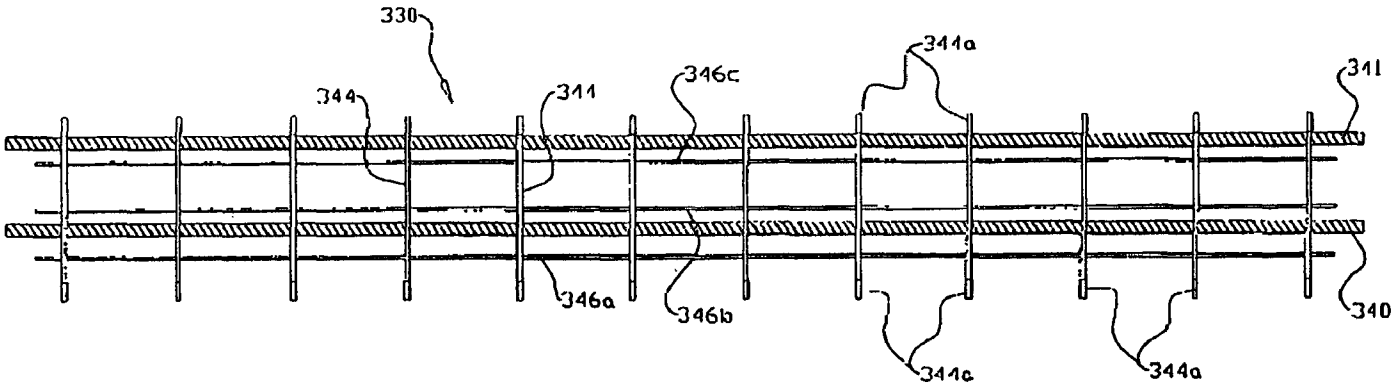
Fig. 5d
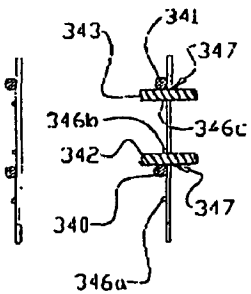
Fig. 5e
Fig. 5c
Fig. 5f

FORMWORK FOR ERECTING REINFORCED CONCRETE WALLS, INCLUDING CONCRETE WALLS WITH TEXTURED SURFACES

TECHNICAL FIELD

The present invention relates to the field of construction, and in particular, to the construction of reinforced concrete walls and systems and methods for making the same, including reinforced concrete walls with textured surfaces.

BACKGROUND OF THE INVENTION

Reinforced concrete walls are well known structures and generally comprise vertically upstanding bodies of concrete impregnated with reinforcement members, commonly known as rebar.

It is known to make such concrete walls by providing traditional formwork made out of plywood boards with appropriate bracing members. More recently, form systems have been employed which employ use of pre-fabricated units provided as a three dimensional geometrically stable structure having a pair of spaced panels held in spaced relation to each other and provided with tie rods. The pre-fabricated units can be secured to one another to provide the form for a concrete wall.

It is also often desirable to have thermal insulation of the concrete wall on one or both sides of such a concrete wall. Thus, panels in the pre-fabricated units used for concrete wall construction are made from rigid insulating materials, such as foamed polystyrene. This insulation material is often covered with other materials such as drywall, stucco, plaster and etc. It is also often desirable to provide esthetically pleasing visible surfaces for the concrete wall.

SUMMARY OF INVENTION

According to one aspect of the invention, there is provided a spacer for use with a panel member used in a construction form. The spacer comprises: (a) first and second rod members which have first portions oriented generally in or towards a first direction. The first and second rod members are spaced apart in a second transverse direction that is orthogonal to the first direction and the first and second rods is in generally spaced, and generally parallel relation to each other. Each of the first and second rod members has an end portion that is oriented at an angle to the first portions of the rod members. The angle is oriented toward a third longitudinal direction that is orthogonal to the first direction and the second direction; (b) a first transverse rod member secured proximate to or at the end portion of the first and second rod members and extending generally in the second transverse direction between the first and second rod members; (c) a second transverse rod member secured to the end portions of each of the first and second rod members. The second transverse rod member is spaced in the first and third directions from the first transverse rod member, and the second transverse rod member extends generally in the second transverse direction between the first and second rod members; and, (d) the first and second vertical rod members. The first and second transverse rod members defines and provides therebetween a retaining cell, for receiving therethrough and retaining an elongated reinforcement member oriented generally in one or both of the first and third directions.

According to another aspect of the present invention, there is provided a combination of first and second spacers for use in combination with a panel member used in a construction form for a wall. Each of the first and second spacers comprises: (a) first and second rod members which have first portions oriented generally in or towards a first direction. The first and second rod members are spaced apart in a second transverse direction that is orthogonal to the first direction and the first and second rods are in generally spaced, and generally parallel relation to each other. Each of the first and second rod members has an end portion that is oriented at an angle to the first portions of the rod members. The angle is oriented toward a third longitudinal direction that is orthogonal to the first direction and the second direction; (b) a first transverse rod member secured proximate to or at the end portion of the first and second rod members and extending generally in the second transverse direction between the first and second rod members; (c) a second transverse rod member secured to the end portions of each of the first and second rod members. The second transverse rod member is spaced in the first and third directions from the first transverse rod member, and the second transverse rod member extends generally in the second transverse direction between the first and second rod members; and (d) the first and second vertical rod members. The first and second transverse rod members define and provide therebetween a retaining cell, for receiving therethrough and retaining an elongated reinforcement member oriented generally in one or both of the first and third directions. The retaining cell of the first spacer is spaced in the first direction from the retaining cell of the second spacer, and the retaining cell of the first spacer is substantially aligned within the second and third directions with the retaining cell of the second spacer to permit the reinforcement member to be held in a direction generally oriented to the first direction, by the first and second retaining cells.

According to another aspect of the present invention, there is provided a panel unit comprised of at least one upstanding and longitudinally oriented panel member and a spacer mounted to the panel member. The spacer is comprised of (a) first and second rod members which have first portions oriented generally in or towards a first direction. The first and second rod members are spaced apart in a second transverse direction that is orthogonal to the first direction and the first and second rods are in generally spaced, and generally parallel relation to each other. Each of the first and second rod members has an end portion that is oriented at an angle to the first portions of the rod members. The angle is oriented toward a third longitudinal direction that is orthogonal to the first direction and the second direction. (b) a first transverse rod member secured proximate to or at the end portion of the first and second rod members and extends generally in the second transverse direction between the first and second rod members; (c) a second transverse rod member secured to the end portions of each of the first and second rod members. The second transverse rod member is spaced in the first and third directions from the first transverse rod member, and the second transverse rod member extends generally in the second transverse direction between the first and second rod members; and (d) the first and second vertical rod members. The first and second transverse rod members define and provide therebetween a retaining cell, for receiving therethrough and retaining an elongated reinforcement member oriented generally in one or both of the first and third directions.

According to another aspect of the present invention, there is provided a connector assembly for use in securing a panel member to a transverse tie rod. The connector assembly comprises a cap member which has a flange cap portion and a shaft portion with an end which has an opening adapted to be interconnected to an end portion of a tie rod; and, a bushing member which has a flange portion and an axially aligned shaft portion with an end opposite to the flange portion. The bushing member has a continuous cavity formed in and passing through the flange portion and the shaft portion. The shaft portion of the cap member is receivable axially into the continuous cavity of the bushing member through the flange portion toward the end of the shaft portion so as to be able to engage the end of the tie rod extending through the end of the bushing member into the continuous cavity. The shaft portion of the cap member also engages an abutment in the continuous cavity of the bushing member so as to limit the extent of axial movement of the shaft portion of the cap member relative to the bushing member toward the end of the shaft portion of the bushing member. A panel member can be held between the flange portion of the cap member and the flange portion of the bushing member.

According to another aspect of the present invention, there is provided a connector assembly for use in securing a panel member to a transverse tie rod. The connector assembly comprises a cap member which has a flange cap portion and a shaft portion with an end that has an opening adapted to be interconnected to an end portion of a tie rod; and, a bushing member which has a flange portion and an axially aligned shaft portion with an end opposite to the flange portion. The bushing member has a continuous cavity formed in and passing through the flange portion and the shaft portion. The shaft portion of the cap member is receivable axially into the continuous cavity of the bushing member through the flange portion toward the end of the shaft portion for releasable engagement with the end of the tie rod which extends through the end of the bushing member into the continuous cavity. The flange portion of the bushing has at least one aperture which passes therethrough, the aperture and has an opening which permits the fluid communication of flowable concrete into the aperture. The aperture is configured such that when concrete flows into and hardens in the aperture, the hardened concrete in the aperture which is integrally connected to hardened concrete outside of the aperture provides an anchoring device to hold the bushing member in the hardened concrete.

According to another aspect of the present invention, there is provided a connector for use in securing a panel member to a tie rod. The connector has a flange cap portion and a shaft portion with an end that has an opening into a cavity. The tie rod has a plurality of separate circular teeth, which have an outer diameter that is larger than the inner diameter of the inner wall of the cavity in the shaft, spaced from each other. The shaft portion is made of a material that will elastically deform to receive the teeth of the end portion of the tie rod, such that when the tie rod end is forced through the opening into the cavity, the inner wall will bind with the teeth to provide a connection that resists axial loading of the connector tending to pull the rod out of the cavity of the shaft.

According to another aspect of the present invention, there is provided a connector for use in securing a panel member to a transverse tie rod. The connector is comprised of a cap flange portion and a shaft portion with an end having an opening adapted to be interconnected to a transverse tie rod which has an end portion; and, a cutting element positioned beneath an under surface of the cap flange portion. When the connector member is rotated to provide a connection with the tie rod, and the connector member is axially drawn toward the tie rod, a panel member can be held between the flange portion of the cap member and the flange portion of the spacer member, and the cutting element will form a recess in an outer surface of the panel member which receives the cap flange portion.

According to another aspect of the present invention, there is provided a connector assembly for use in securing a panel member to a transverse tie rod. The connector assembly comprises a cap member having a flange cap portion and a shaft portion with an end which has an opening adapted to be interconnected to an end portion of a tie rod; and, a bushing member which has a flange portion and an axially aligned shaft portion with an end opposite to the flange portion. The bushing member has a continuous cavity formed in and passing through the flange portion and the shaft portion. The shaft portion of the cap member is receivable axially into the continuous cavity of the bushing member through the flange portion toward the end of the shaft portion for releasable engagement with the end of the tie rod which extends through the end of the bushing member into the continuous cavity and the end of the bushing member has guide members that depend inwardly to guide the end of the tie rod into axial alignment with the opening in the cap portion.

According to another aspect of the present invention, there is provided a method of forming a concrete wall comprising the steps of providing a panel member as part of a formwork and interconnecting a connector assembly to a tie member through the panel member. The connector assembly comprises a cap member which has a flange cap portion and a shaft portion with an end which has an opening adapted to be interconnected to an end portion of a tie rod; and, a bushing member which has a flange portion and an axially aligned shaft portion with an end opposite to the flange portion. The bushing member has a continuous cavity formed in and passing through the flange portion and the shaft portion. The step of connecting comprises (a) positioning the bushing member with the flange portion proximate an inner surface of the panel member and moving the end portion of the tie rod through the cavity in the bushing member and (b) positioning the cap portion of the cap member proximate an outer surface of the panel member and moving the shaft portion of the cap member through the panel member and axially into the continuous cavity of the bushing member through the flange portion toward the end of the shaft portion for releasable engagement with the end of the tie rod; (c) pouring the concrete into the formwork and allowing the concrete to harden; (d) dis-engaging the cap member from the end of the tie rod; and, (e) removing the cap member.

According to another aspect of the present invention, there is provided a method of providing formwork with a panel unit. The panel unit comprises an upstanding panel member and at least one tie rod which has an end portion. The method comprises employing a connector to engage the end of the tie rod through the panel. The connector comprises a cap flange portion and a shaft portion with an end which has an opening adapted to be interconnected to the tie rod and a cutting element positioned beneath an under surface of the cap flange portion, The method includes the step of rotating the connector to provide a connection with the tie rod, and wherein the connector is axially drawn onto the tie rod, the panel member is held between the flange portion of the cap member and the flange portion of the spacer member, and the cutting element will form a recess in an outer surface of the panel member for receiving the cap flange portion.

According to another aspect of the present invention, there is provided a panel unit for use as part of a concrete form for a reinforced concrete wall. The panel unit comprises a pair of spaced apart panels both oriented in or towards a first longitudinal direction; a form liner panel positioned between the first and second panels proximate an inner surface of the first panel; and, a spacer comprised of (a) first and second rod members oriented generally in or towards a second direction that is orthogonal to the first direction, the first and second rod members are in generally spaced, parallel and planar relation to each other; and, (b) a transverse rod member oriented generally in or toward a third transverse direction that is orthogonal to the first direction and the second direction. The transverse rod member is secured to and extends between the first and second panels. The transverse rod member has a first end and an opposite second end adapted for securing the reinforcement unit to a panel connector mounted to each the first and second panel members, respectively, so as to provide at least one transverse tie rod member between the first and second panels.

According to another aspect of the present invention, there is provided a panel unit for use as part of a concrete form for a reinforced concrete wall. The panel unit comprises: (a) first and second generally vertically oriented panels arranged wherein each has a surface in an adjacent position to each other. The surface of the first panel is oriented longitudinally at an angle to the surface of the second panel; (b) a connector associated with each of the first and second panels. Each connector has a flange portion positioned proximate the surface of the first panel and the second panel, and each connector has a shaft portion which extends from the flange portion and passes through its respective panel and is secured to a tie rod member; and, (c) an angled plate member which has a first plate portion positioned against a surface of the first panel, and a second plate portion which is oriented substantially at the angle to the first plate portion and is positioned against a corresponding adjacent surface of the second panel. Each of the plate portions has an opening or slot which receives therein the shaft portion of the respective connector or the tie rod member. Each respective plate portion is held between the two members in a substantially fixed position relative to first and second panels, so as assist in holding the first and second panel in a substantially stationary position relative to each other.

According to another aspect of the present invention, there is provided a panel unit for use as part of a concrete form for a reinforced concrete wall. The panel unit is comprised of: (a) pair of spaced apart generally upstanding and longitudinally oriented panels defining a form space there between. The first panel has a longitudinally extending gap between a panel upper portion and a panel lower portion; (b) a ledge form unit comprised of at least one ledge form member, provides a form for a ledge to extend the form space through the gap that provides a form for a ledge portion; (c) a spacer comprised of first and second transverse tie rod members that are secured to and extend between the first and second panels and are in spaced apart relation to each other. The first and second transverse rod members have a first end and an opposite second end each adapted for securing the first and transverse tie rods to a panel connector member which has an outer flange positioned at an outer surface of the first and second panel members, respectively, so as to provide transverse tie rod members between the first and second panels. A connector of the first tie rod is mounted to the upper portion of the first panel, and a connector of the second tie rod is mounted to the lower portion of the first panel; and, (d) an angled plate member which has a first plate portion positioned against the a surface of the upper portion of the first panel, and a second plate portion positioned against a surface of the lower portion of a surface of the first panel. Each of the first and second plate portions has a slot or opening that receives therein a shaft portion of the respective connector or the tie rod member, to hold the plate member in a substantially fixed position relative to first and second panels, and, to assist in holding the upper and lower panel portions in a substantially stationary position relative to each other. The angled plate member also comprises a third plate portion that extends from the first plate portion over the gap to second plate portion. The third plate portion acts as a support member for the ledge form member.

According to another aspect of the present invention, there is a panel unit for use as part of a concrete form for a reinforced concrete wall. The panel unit is comprised of a pair of spaced apart longitudinally oriented foamed plastic panels that define a form space there between and a spacer comprised of at least one transverse tie rod member, which has a first end and an opposite second end each adapted for securing the transverse tie rod to a panel connector member wherein at least one of the panel connectors is releasable from the tie rod, the tie rod being thus secured to and extending between the first and second panels. The first panel member has at least one inner surface treated with a material that has enhanced non-adhesive properties, such that the inner surface will tend not to bond extensively to the hardening or hardened concrete, and wherein the at least one connector can be released and the connector and the first panel removed.

According to another aspect of the present invention, there is provided a method of forming a reinforced concrete wall with a panel unit as part of a form work. The panel unit is comprised of: (a) a pair of spaced apart longitudinally oriented foamed plastic panels that define a form space there between; (b) a spacer comprised of at least one transverse tie rod member, which has a first end and an opposite second end each secured to a panel connector to secure the panels with the tie rod, that is secured to and extends between the first and second panels; and, (c) at least one reinforcement member positioned in the form space. The first panel member has at least one inner surface treated with a material that has enhanced non-adhesive properties, such that the inner surface will tend not to bond extensively to the hardened concrete. The method comprises the steps of: (a) arranging the panel unit as part of the formwork; (b) filling the form space with unhardened concrete and allowing the unhardened concrete to sufficiently harden to be able to permit removal of the formwork; (c) releasing the releasable panel connector from securement to the tie rod; and, (d) removing the first panel member from the formwork.

According to another aspect of the present invention, there is provided a panel unit comprised of at least one upstanding panel member oriented in a longitudinal direction and a spacer mounted to the panel member. The spacer is comprised of a rod member and a reinforcement bar member oriented generally in or towards a first direction. The rod member and the reinforcement bar member, which are in generally spaced, planar and generally parallel relation to each other, are spaced apart in a second transverse direction that is orthogonal to the first direction. A transverse rod member is secured to and extends generally in the second direction between the rod member and the reinforcement bar member; such that the rod member, the reinforcement bar member and the transverse rod member form a substantially planar, rigid geometrically stable grid.

BRIEF DESCRIPTION OF THE DRAWINGS

In drawings that illustrate by way of example only, preferred embodiments of the present invention:

FIG. 4*b* is a re-oriented front view of a spacer for central reinforcement and positioning of the formwork boards used in the panel unit of FIGS. 4 and 4*a;*

FIG. 4*c* is a re-oriented side view of the spacer for central reinforcement and positioning of the formwork boards employed in the panel unit of FIGS. 4 and 4*a;*

FIG. 4*d* is a top plan view spacer for central reinforcement and positioning of the formwork boards of FIGS. 4*b* and 4*c;*

FIG. 4*e* is a top plan view similar to FIG. 4*d* showing vertical and horizontal reinforcement members installed in the cells of the spacer for central reinforcement of the wall;

FIG. 4*f* is a re-oriented side view of an alternate embodiment of a spacer for peripheral reinforcement and positioning of the formwork boards that could be employed in a panel unit similar to the panel unit illustrated FIGS. 4 and 4*a;*

FIG. 4*g* is a top plan view of the spacer for peripheral reinforcement and positioning of the formwork boards of FIG. 4*f;*

FIG. 4*h* is a top plan view similar to FIG. 4*g* but showing vertical and horizontal reinforcement members installed in the cells of the spacer for peripheral reinforcement of the wall;

FIG. 5*a* is a re-oriented side view of the spacer with pre-installed vertical re-bars for central reinforcement of the wall employed in the panel unit of FIG. 5;

FIG. 5*b* is a top plan view of the spacer of FIG. 5*a;*

FIG. 5*c* is a top plan view similar to FIG. 5*b* but with a horizontal reinforcement member installed in the cell of the spacer;

FIG. 5*d* is a re-oriented side view of another similar spacer for the panel unit of FIG. 5 with pre-installed vertical re-bars for peripheral reinforcement of the wall;

FIG. 5*e* is a top plan view of the spacer of FIG. 5*d;*

FIG. 5*f* is a top plan view similar to FIG. 5*e* but with two horizontal reinforcement members installed in the cell of the spacer;

DETAILED DESCRIPTION

Figure 1:
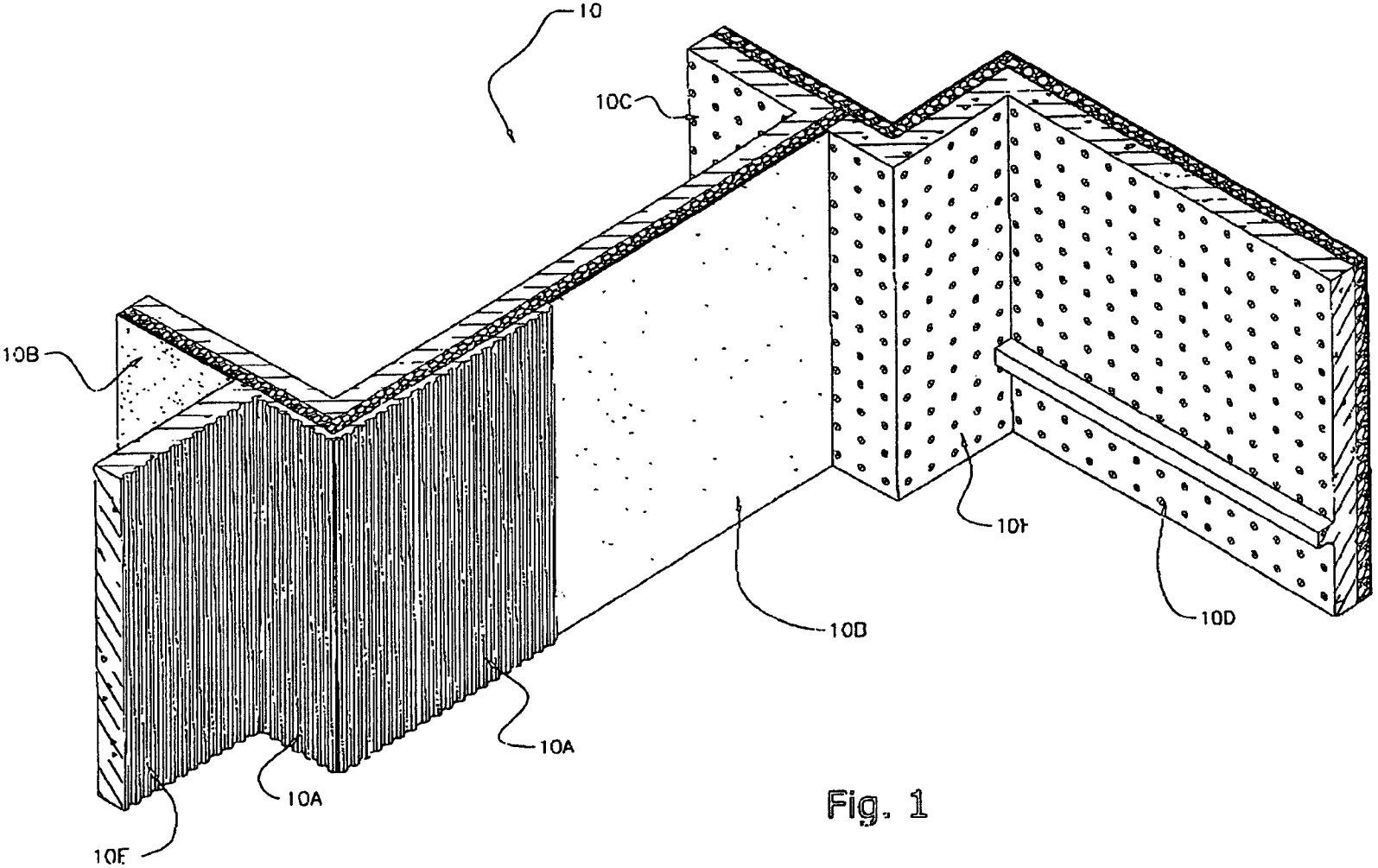
FIG. 1 is a top perspective schematic view of several reinforced concrete wall segments, linked together.

With reference to FIG. 1, a concrete wall structure made from several segments and having textured surfaces is generally designated 10. The concrete wall is built using panel units as described hereinafter. Wall structure 10 is for illustrative purposes and it shows only one particular application.

Figures 9, 9A, 9B:
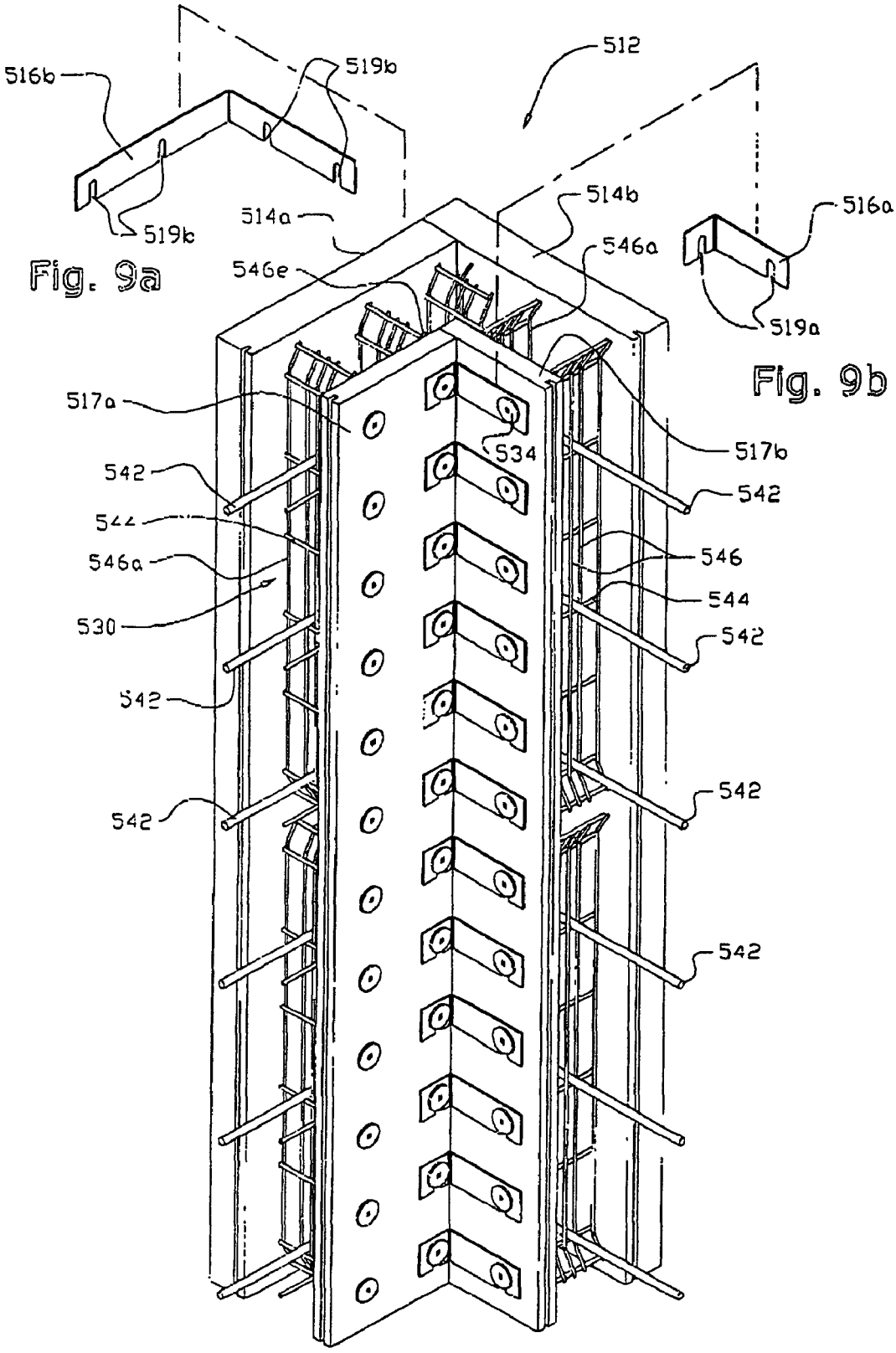
FIG. 9 is an enlarged perspective view showing the connection of two panels units as shown FIG. 4, 4*a* into a corner panel unit, which can be used to produce segment 10F of the reinforced concrete wall as shown in FIG. 1.
FIG. 9*a* illustrates the outer panel plate connector used for the connection of two panels units of FIG. 4, 4*a* into the corner panel unit of FIG. 9.
FIG. 9*b* illustrates the inner panel plate connector used for the connection of two panels units of FIG. 4, 4*a* into corner panel unit of FIG. 9.

Wall 10 comprises separate wall segments 10A, 10B, 10C, 10D, 10E, and 10F. As will be explained in further detail hereinafter, wall section 10A has a cross-sectional configuration, which is shown in FIG. 13*b*, wall sections 10B, 10C have the cross-sectional configuration shown in FIG. 12*b* and wall section 10E has the general cross-sectional configuration shown in FIG. 14*b*. Additionally, the wall section 10D in FIG. 1 is substantially similar to the wall section shown in perspective view in FIG. 11. Additionally, the wall segment 10F has a cross-sectional configuration shown in FIG. 12*b* made from interconnected panel units in FIG. 4, 4*a*, 5, 12*a* and with panel units joined as shown in FIG. 9.

The apparatus and methods described hereinafter provide details of systems and methods to make the wall sections designated 10A-10F, as shown in FIG. 1, and components used in connection therewith.

Figure 4:
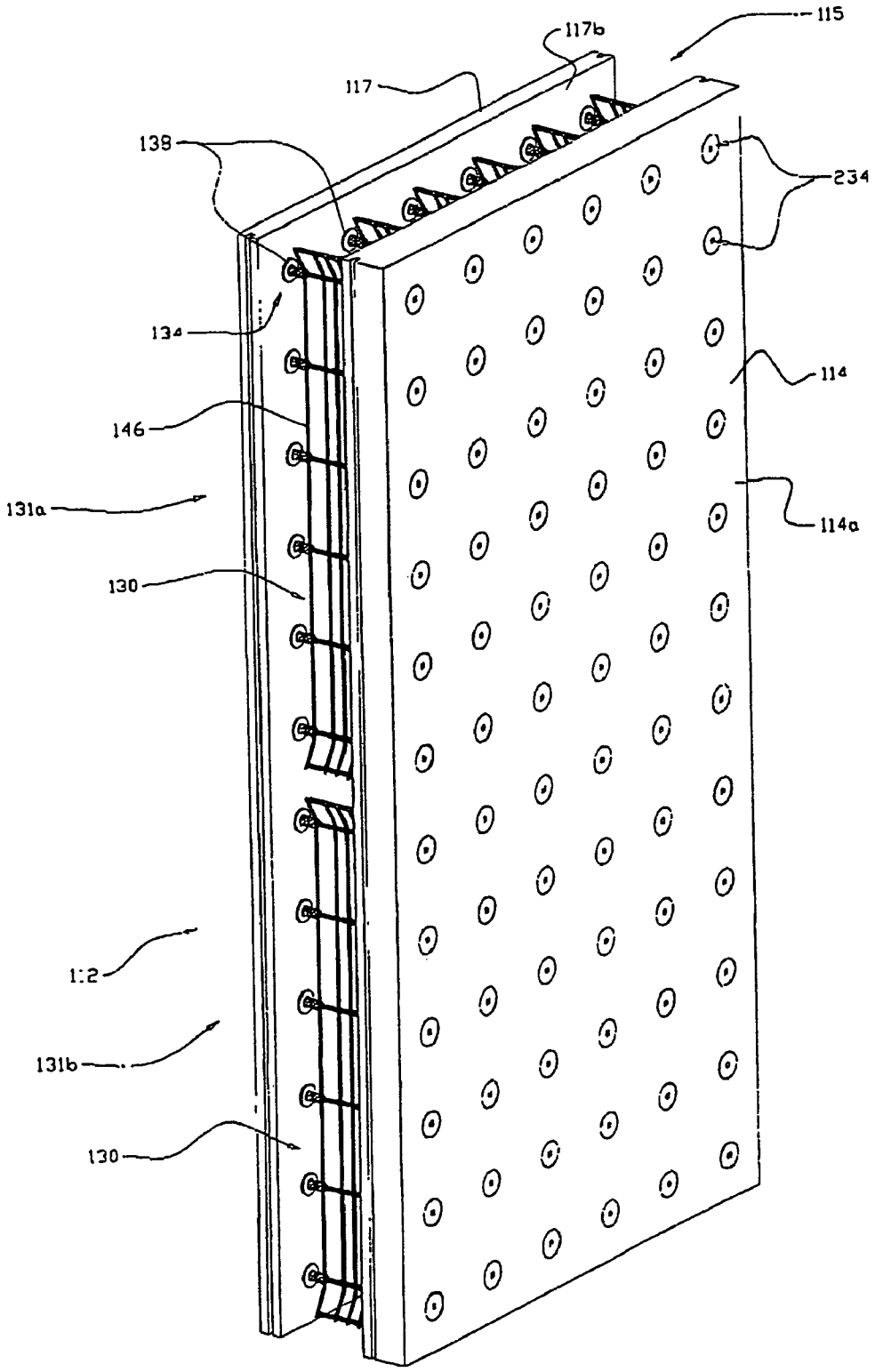
FIG. 4 is a front perspective view of one of the panel units that can be employed in a formwork system to build reinforced concrete wall segment identified as 10B, 10C, 10D in FIG. 1.
Figure 4A:
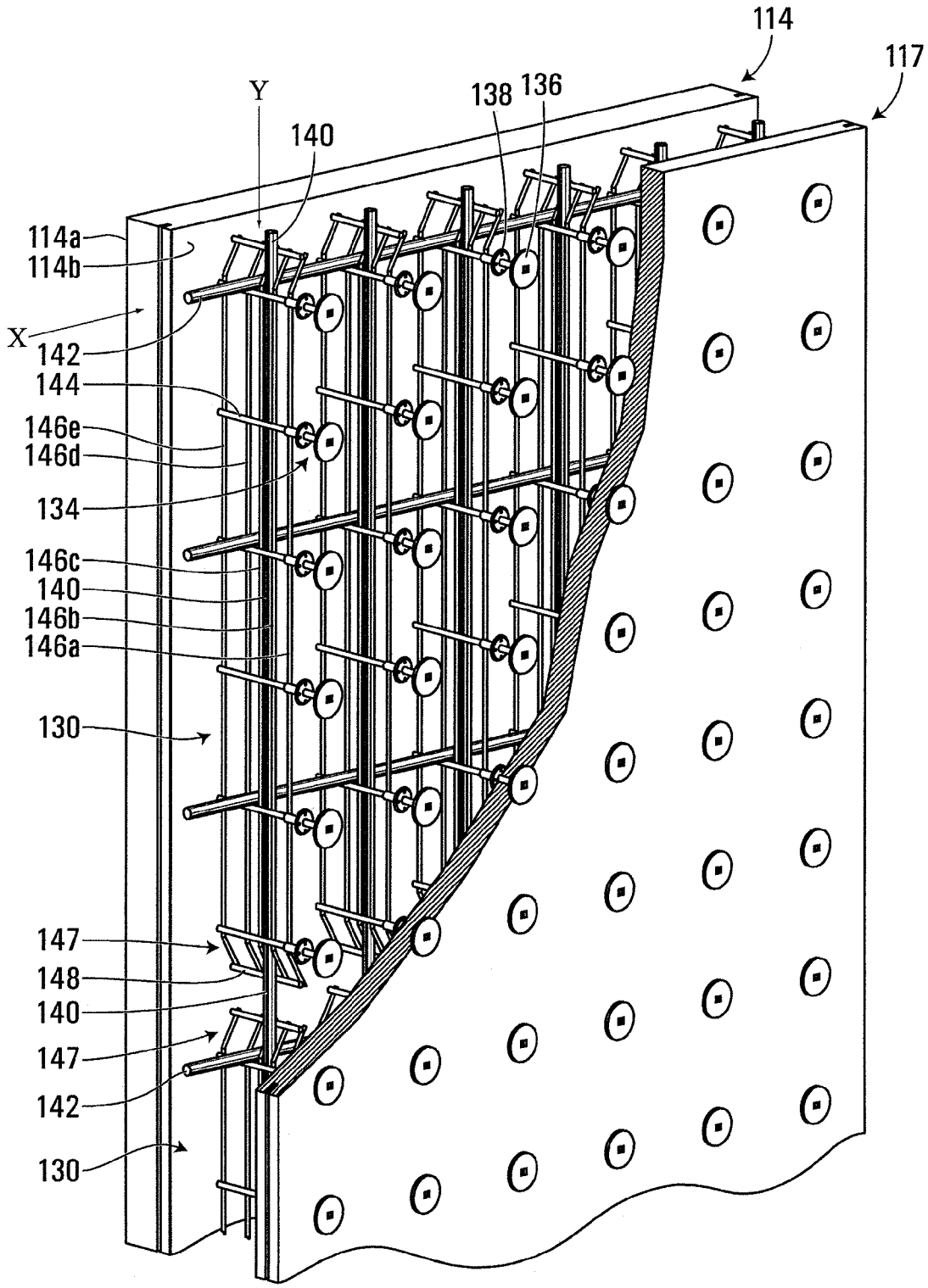
FIG. 4*a* is a enlarged rear perspective view, partially cut away, of part of the panel unit of FIG. 4 with visible installed vertical and horizontal rebar fragments for the central reinforcement of the wall.

With reference now to FIGS. 4 and 4*a*, a panel unit generally designated 112 is illustrated. Panel units 112 can be joined together with one or more other panel units, or used in conjunction with other formwork components to provide a suitable form for a concrete wall. Panel units 112 can be pre-fabricated at an off-site fabrication plant and then delivered to the construction site for use. Alternatively, the panel units could be constructed at he construction site from components supplied thereto. Panel unit 112 includes a pair of spaced apart panel members 114, 117. Panels 114, 117 may be made from any of a number of materials, and may in some embodiments be made from the same material. However, it is preferred that in this embodiment panel 114 is made from expanded foam polystyrene (e.g. Grade EPS ASTM C 578-00 Type IX) or extruded foam polystyrene panels (e.g. Grade XPS ASTM C 578-00 Type IV). Panel 117 is preferably made from a flat stronger material such as for example, plywood, OSB, particleboard, CBPB (cement-bonded particle board), rigid polystyrene laminated with plastic film or from specially molded expanded polypropylene (EPP) boards or expanded polystyrene boards and may be provided with form liners (as described further hereinafter) on or proximate the inner surface. Panel 114 has an outer surface 114*a* and an inner surface 114*b*. Likewise panel 117 has an outer surface 117*a*, and an inner surface 117*b* opposing surface 114*b* of panel 114.

Panels 114 and 117 can be of any useful size but preferably are in the range of 48" to 96" wide by 48" to 144" in height. Panels 114 may have a depth in the range of 2" to 6", whereas panels 117 may have a depth in the range of ½" to 6".

As will be appreciated, the gap between panel members 114, 117 provides for a form space 115 into which unhardened concrete can be poured to form a concrete wall.

The panel members 114, 117 are oriented generally longitudinally and held in the spaced, generally parallel relation to each other by a spacer generally designated 130 and connectors such as for example, connectors 134 and/or connectors 234. Each spacer 130 has a plurality of transverse rod members 144 with end portions 144*a* at either end for engaging connectors, which in this embodiment are at one end generally designated 134 and at the other end connectors 234.

Figures 2A, 2B:
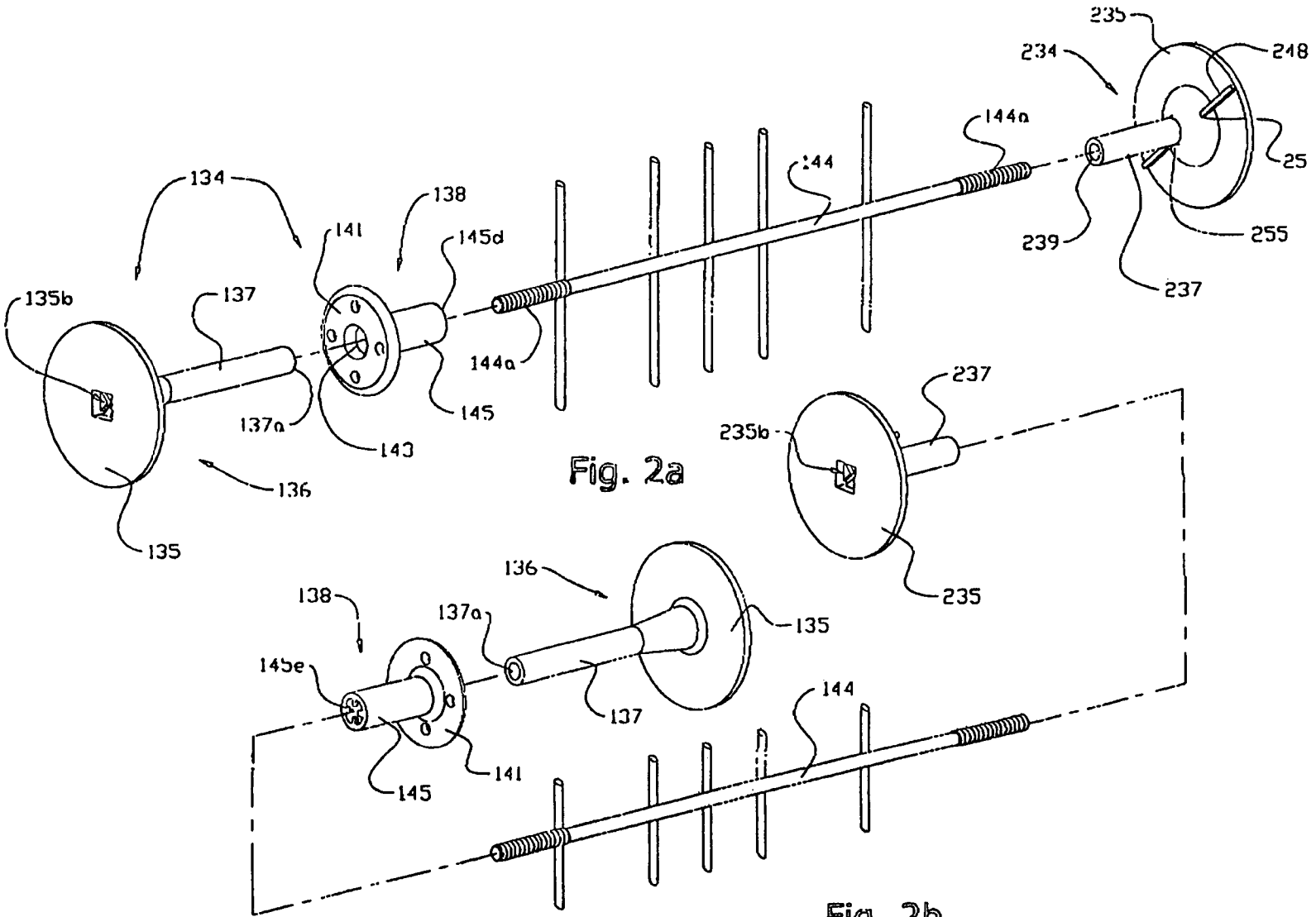
FIG. 2*a* is a perspective view of connectors employed in the panel unit of FIGS. 4, 4*a* and 5.
FIG. 2*b* illustrates in detail the connectors of FIG. 2*a* in reverse perspective views.
Figure 3C:
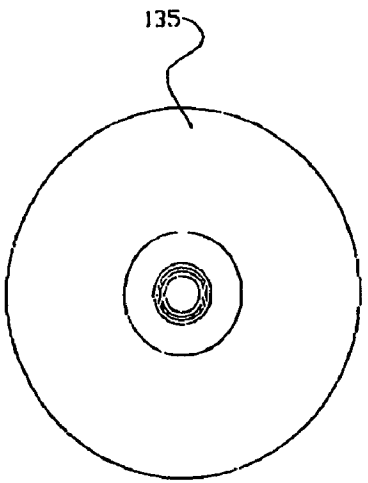
FIG. 3*c* is a bottom plan view of the cap member of FIGS. 3*a* and 3*b;*
Figure 3B:
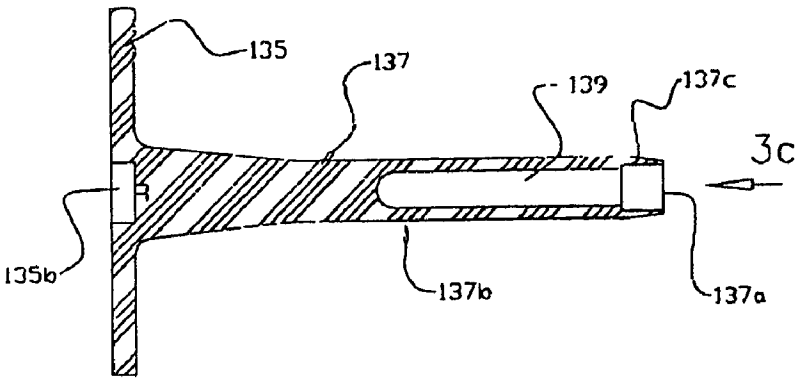
FIG. 3*b* is a sectional view at 3*b*-3*b* in FIG. 3*a;*
Figure 3A:
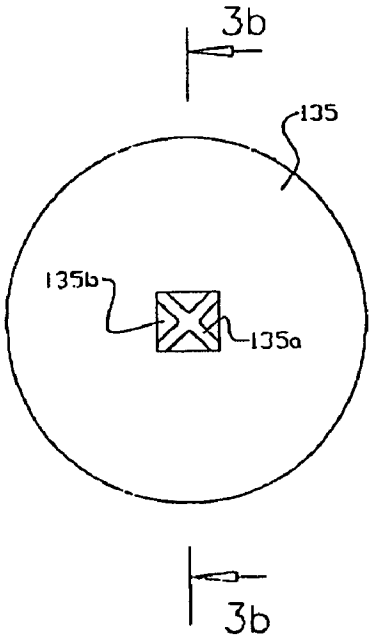
FIG. 3*a* is a top plan view of a cap member comprising a part of one of the connectors of FIGS. 2*a* and 2*b;*

Connectors 134 and 234 as shown in FIGS. 2*a* and 2*b*, when tightened on rods 144, slightly compress the material of panels 117 and 114, resulting in the formation of a rigid or semi-rigid composite unit where the panels 117 and 114 are held in a rigid or semi-rigid position relative to the spacer 130.

Figure 8:
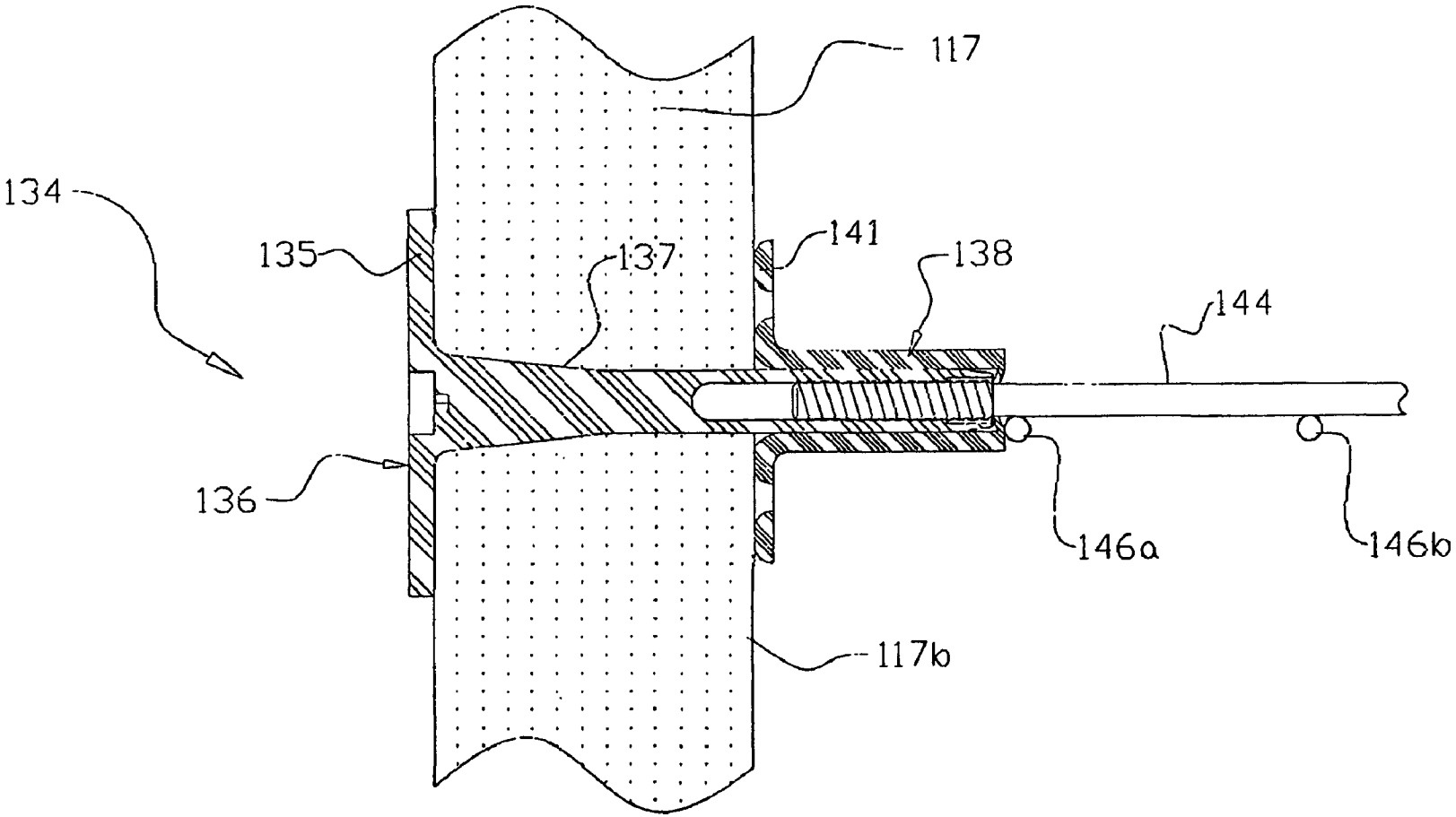
FIG. 8 is a top plan cross-sectional view of one of the connectors of FIGS. 2*a* and 2*b* mounted to a panel as shown in FIGS. 4 and 4*a*, in accordance with an example embodiment of the invention.

In this preferred embodiment, connector members 134 are used to connect the spacers 130 to panels 117, and include an outer cap member 136 and a bushing member 138, as shown in FIG. 8. Cap member 136 and bushing 138 can be made of numerous materials. Preferably cap member 136 is made of a suitable plastic such as polypropylene. Bushing 138 can be made of recycled plastic materials due to the less onerous mechanical requirements for this member.

Bushing member 138 has a flange cap 141 and a shaft portion 145 and is positioned between a vertical rod member 146*a* (not shown in FIGS. 2*a* and 2*b*, but shown in FIG. 8) of spacer 130 and the inner surface 117*b* of panel 117. The flange cap 135 has a surface area that is in abutment with the inner surface 117*b*. The bushing member 138 has its shaft portion 145 that is secured to, or integrally formed with, its flange cap 141.

The outer cap member 136 has a cap flange 135 and a shaft portion 137 (FIGS. 2*a*, 2*b*, and 3*a*-3*c*). Shaft portion 137 passes through a perforation in panel 117, that may be preformed by conventional devices and methods. The perforations in panel member 117 allow the shaft 137 to pass through the panel member 117 and engage an end 144*a* of a transverse rod 144 through an inner generally cylindrical, axially extending cavity 151 extending through cap portion 141 and into shaft portion 145 of bushing member 138. The cap members 136, which engage and can by rotation be drawn onto the end portions 144*a* of transverse rods 144, slightly compress the panel members 114 between the head flange 135 of the cap member and the flange portion 141 of the bushing member 138. As connector 136 is tightened and drawn onto rod 144, the shaft 137 pushes bushing member 138 such that the end 145*a* of its shaft 145 moves up into abutment against vertical rod member 146*a* of the spacer 130. This will typically result in bushing member 138 itself being put in some degree of axial compression. To provide the assembly of the panel unit and permit more easily the entering of shaft portion 137 of the cap member 136 into cavity 151 of the bushing member 138, the end 145*a* of the bushing member 138 has a configuration with cantilevered strip or tab portions 145*e*, which provide central positioning of the bushing member 138 on to the end 144*a* of rod 144. Cap member 141 of the bushing member 138 has cone shape openings 141*a* (with the cone narrowing in an inward direction), which provides the hardened concrete with a mechanism to hold the bushing member 138 in place in the concrete wall after removal of polystyrene boards 117 and plastic connectors 136 in the concrete surface. Other known shapes for the openings can be employed to fulfill the function of providing an anchoring mechanism. This is particularly useful in holding the bushing member 138 in place in the wall after the connector 134 has been removed. This is because due to thermal expansion if for example the concrete wall and connector are heated by the sun, the bushing 138 might otherwise tend to move outward and look unappealing. The end 144*a* is in a preferred embodiment made in the form of parallel separate circular teeth, or with spiral toothed tips. The outer diameter of the spiral tooth or concentric circular teeth on each end 144*a* is a little more than the diameter of the opening 137*a* in the shaft portion of cap member 136, and of the inner diameter of cavity 139. This provides for a connection between the cap member 136 and the end 144*a* with the translational movement of the cap member 136 through the perforation through the polystyrene board 117 and opening 151 in the space member 138. Thus the end 144*a* might serve as a tap on the inner surface of cavity 139, of there may be a pre-existing threading relation between the teeth and the inner wall. In the case of the circular teeth, the material of the shaft 137 is sufficiently elastic such that the inner wall material can deform around the teeth as the rod end 144*a* is pushed into the cavity 139. This provides a holding mechanism, to hold cap member 136 in an axial stable position relative to rod 144*a*, and can resist some degree of outward directed axial forces, such as when the concrete is poured into the form space. Of course, other connections between a connector and the rod end 144*a* can be employed in some other embodiments.

With reference to FIGS. 2*a*, 2*b* and 7*a*-7*c*, connectors 234 each have a cap portion 235 and a shaft portion 237. The cap portion 235 is secured to or integrally formed with, shaft 237. A panel 114 is held rigidly in place relative to each of the spacers 130 between each of the cap portions 235 of each of the connectors 234 attached to the opposite ends of rods 144, and an inner vertical rod 146*e* that is brought into abutment with the inner surface 114*b* of panel 114, as the shaft portion 237 (FIG. 7*b*) is screwed onto a threaded opposite end (also 144*a*) of rod 144, at an opening 237*a*.

The overall result of connecting panels 114, 117 of each panel unit to the several spacers 130 associated therewith, with a plurality of connectors 134, 234, is that the panel units 112 can be formed as a substantially rigid geometrically stable structure capable of being easily moved and arranged in a formwork system to assist in producing a reinforced concrete wall.

It will be noted that in a panel unit 112, a plurality of spacers 130 are arranged in vertical substantially parallel orientation in a first upper bank 131*a*. Each of the spacers 130 in bank 131*a* has a corresponding spacer 130 positioned vertically below it in a second bank 131*b*. Also, it is possible that the panel unit 112 comprises the plurality of spacers similar to spacers 130, which are formed with a length equal to the sum of the length of spacer 131*a* plus the length of spacer 131*b*.

With reference to FIGS. 4*b*, 4*c* and 4*d*, it will be noted that each spacer 130 has a plurality of spaced substantially parallel rod members 146*a-e* which are arranged in a grid with a series of transverse rods 144 being secured to each of rods 146*a-e* that will in the panel unit typically be vertically oriented. Rods 144 and rods 146*a-e* may be made of any suitable material but may be steel wire rods having circular cross sections with a diameter in the range of 2.5-6, and preferably 2.5-3.5 mm. The intersections between each of the rods 144 and rods 146*a-e* can be secured by conventional means, such as by spot welding, to provide an overall rigid grid structure.

It will also be noted that each rod 146*a-e* has an end portion 173*a-e* that is disposed at an angle of a from a straight configuration (or 0° configuration), which is less than 90° and which is preferably but not necessarily, the same and in the range of 20-40 degrees (FIG. 4*b*). When positioned in the panel unit 112, this angle a is disposed from the vertical direction toward the longitudinal direction, as shown in FIGS. 4 and 4*a*.

Additionally, an end rod 148 is transversely oriented and affixed at intersection locations as described above, to end portions 173*a-e* of rods 146*a-e*. End rods 148 at each end are preferably generally parallel to, but spaced from, the last transverse rod 144 in the grid.

It will be noted that thus a series of retaining cells 147 are created as shown in FIGS. 4*a* and 4*e*, for receiving and holding therethrough vertical reinforcement members 140 (which typically will be rebar) and horizontal reinforcement members 142 (typically also rebar). The cells are created between a pair of spaced vertical rods end portions 173*b*, 173*c*, and between end rod 148 and a transverse rod end portions 173*c*, 173*d*. These spacers 130 are used in case of central or single reinforcement of the reinforced concrete walls or concrete walls. Rebar members as referenced herein are preferably made of steel and are generally circular in cross section with a diameter in the range of 5-30 mm, and preferably in the range of 5-20 mm, but can be made of other suitable products. With reference additionally to FIG. 4*b*, vertical reinforcement member 140 can be fed in a vertical direction Y into a retaining cell 147 provided at each end of spacer 130 by end rod 148, a transverse rod 144 and the end portions 173*c*, 173*d* of two spaced apart vertical rod members 146*c*, 146*d*.

From FIG. 4*a*, it will be noted that the cells 147 of the upper bank 131*a* of spacers 130 cooperate with the cells 147 of the lower bank 131*b* of spacers 130 so that the vertical rod members 140 are each held in transverse and horizontal position by cells 147 of both the upper bank and of the lower bank.

As shown particularly in FIG. 4*e*, it is clearly illustrated how the vertical reinforcement members 140 and horizontal members 142 are positioned in relation to transverse rod members 148 and 144 and the end portions of vertical rod members 146*c*, 146*d*.

In FIGS. 4*f* to 4*h*, an alternate embodiment for a spacer 230 is shown that can also be employed in a panel unit 114 to provide peripheral or double reinforcement of the reinforced concrete walls or concrete walls. In FIGS. 4*f* to 4*h*, a spacer 230 comprises a plurality of transverse rod members 244 like rods 144, each with end connecting portions 244*a* at either end. Each rod 244 is oriented generally parallel to one or two adjacent transverse rod members 244 and being spaced therefrom. In this embodiment, however there are an additional number of vertical rod members comprising altogether rods 246*a-h* interconnected as described above to the transverse rod members 244 and having end portions 273*a-h* co-operating with rods 244 and end rod members 249 so as to provide for additional retaining cells 247. It will be appreciated that the side view of FIG. 4*b* is also the side view for the embodiment of FIGS. 4*f* to 4*h*.

As shown in FIG. 4*h*, two sets of cells 247 allow for two horizontal reinforcement members 242 as well as two vertical reinforcement members 240 to be held by the spacers 230, when deployed in a panel unit.

Figure 5:
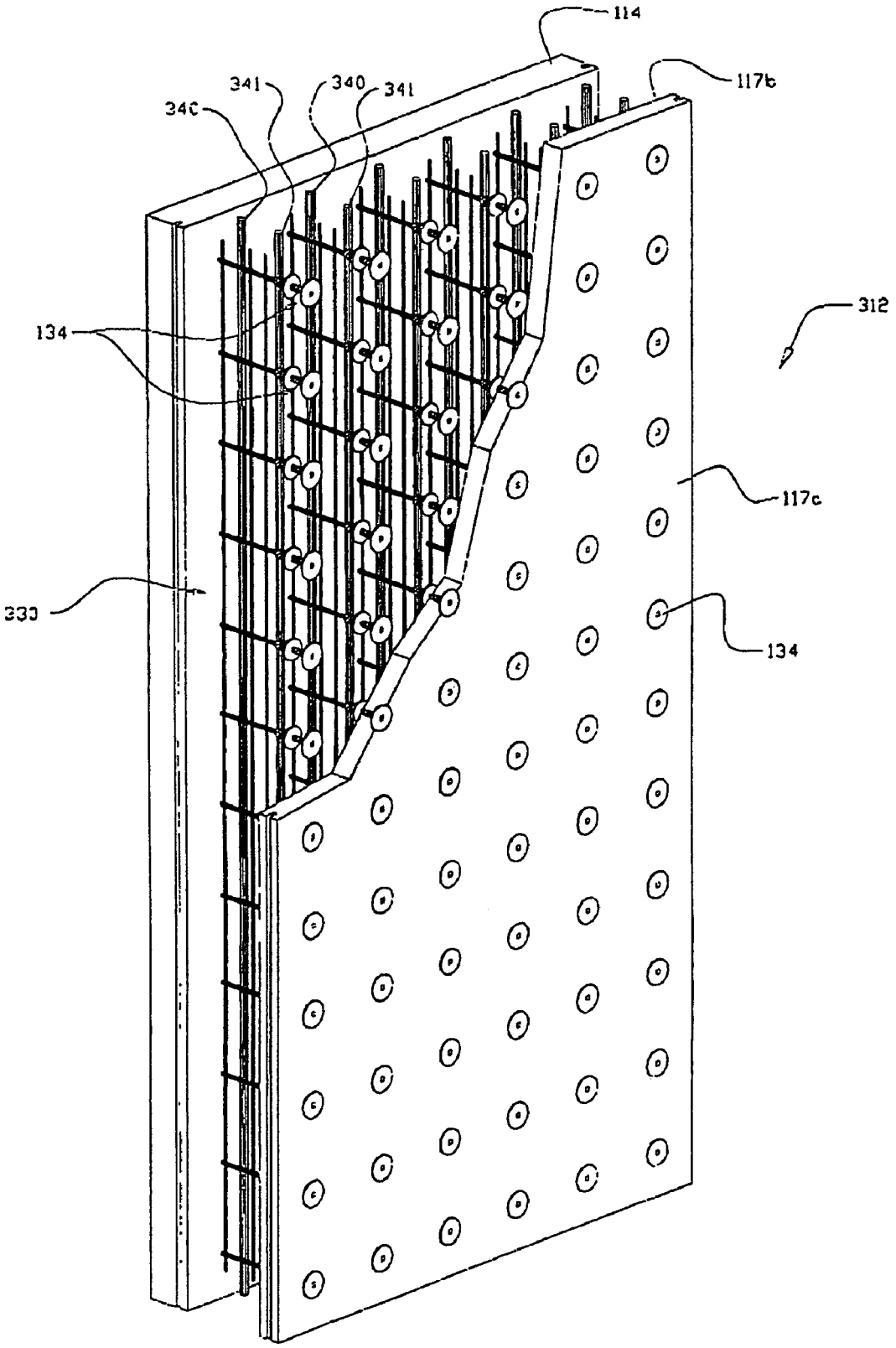
FIG. 5 is a front perspective view of a panel unit similar to panel unit of FIG. 4*a* with an alternate spacer in accordance with another embodiment of the invention.
Figure 6C:
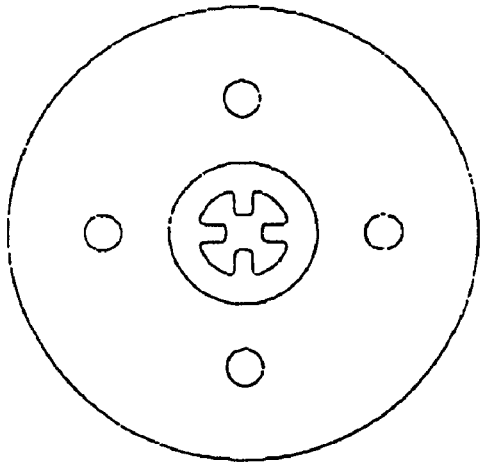
FIG. 6*c* is a bottom plan view of the bushing member of FIGS. 6*a* and 6*b*, in the direction 6*c* shown in FIG. 6*b;*
Figure 6B:
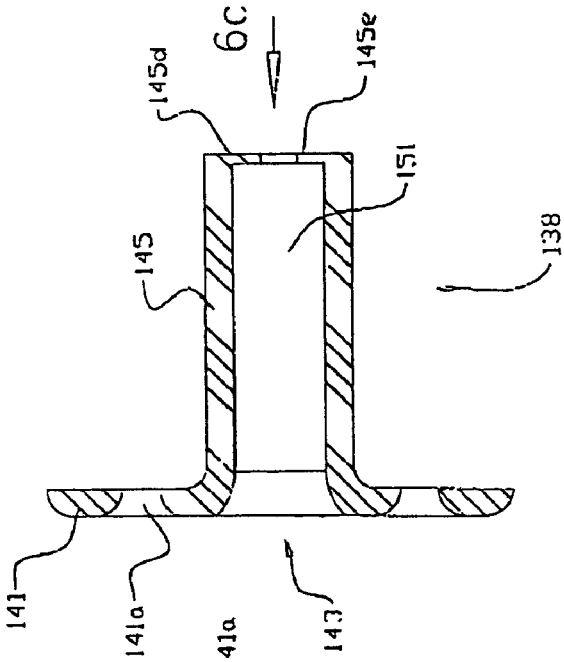
FIG. 6*b* is a cross-sectional view at 6*b*-6*b* in FIG. 6*a;*
Figure 6A:
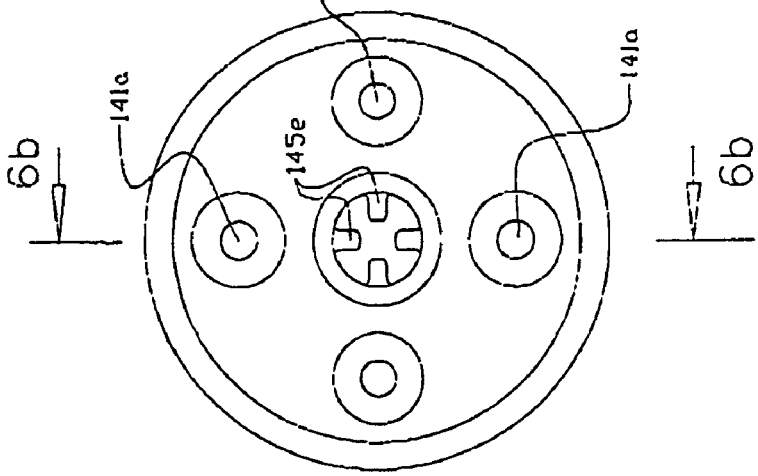
FIG. 6*a* is a top plan view of a bushing member comprising another part of one of the connectors of FIGS. 2*a* and 2*b;*
Figure 7C:
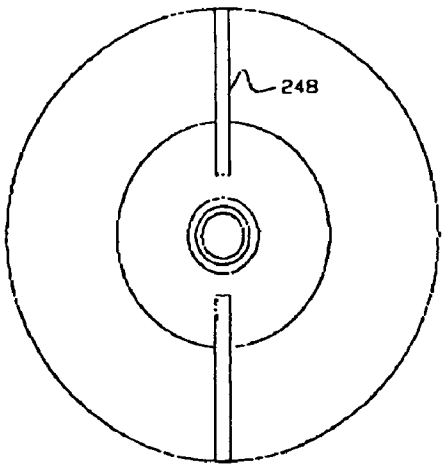
FIG. 7*c* is a bottom plan view of the connector of FIGS. 7*a* and 7*b* in the direction 7*c* shown in FIG. 7*b;*
Figure 7B:
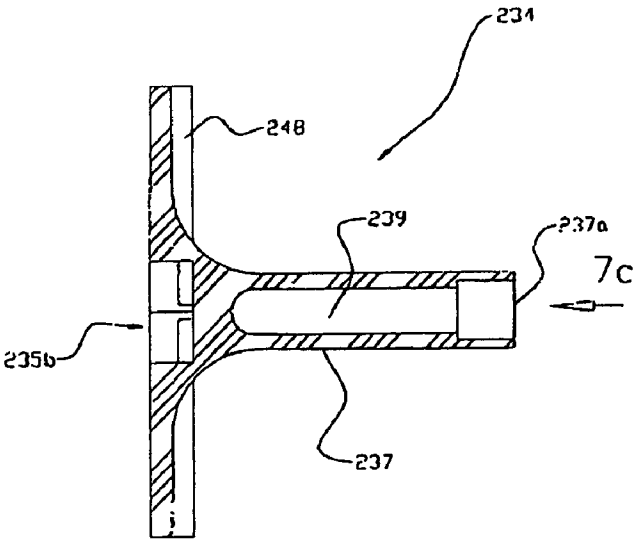
FIG. 7*b* is a cross-sectional view at 7*b*-7*b* in FIG. 7*a;*
Figure 7A:
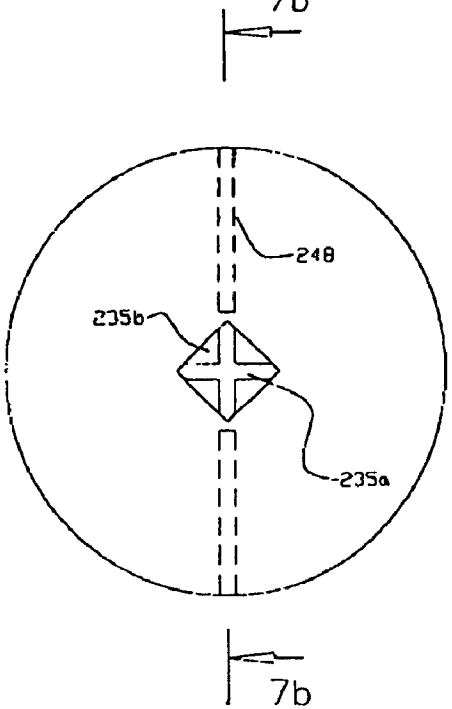
FIG. 7*a* is a top plan view of another of the connectors shown in FIGS. 2*a* and 2*b;*

With reference now to FIGS. 5, 5*d*-5*f*, an alternate configuration for a panel unit generally designated 312 is illustrated. Like panel unit 112, panel unit 312 includes a pair of spaced apart panel members 114, 117. As described above, panels 114, 117 may be made from any of a number of materials, including expanded foam polystyrene. It should be noted the following applies to both panel unit 112 (FIGS. 4 and 4*a*) and panel unit 312 (FIG. 5). Panel 114 has an outer surface 114*a* and an inner surface 114*b*. Likewise panel 117 has an outer surface 117*a*, and an inner surface 117*b* opposing surface 114*b* of panel 114. Due to the use of connectors 134, panel 117 can be removed once the concrete has been poured and at least partially set. To facilitate removal, inner surface 117*b* of the panel 117 can sprayed with a material that is adapted to prevent adhesion with the poured concrete. If the panel 117 made from foamed polystyrene, acrylic mixtures or rubber based materials preferably are used.

Additionally, surface 117*b* can be laminated with a plastic film such as polypropylene using known lamination techniques. To decrease the thickness of the removable expanded foamed polystyrene panel 117, both sides of the panel 117 can be laminated. Lamination of either or both of surface 117*a* and panel 117*b*, makes the panels stronger and allows the re-using of the panels in unit 112 or unit 312.

The panel members 114, 117 are held in the generally longitudinally oriented, parallel spaced position relative to each other by spacers generally designated 330, each of which is configured differently than spacer 130. Spacers 330 are interconnected to panels 114, 117 using connectors 134 and/or connectors 234, just like with spacers 130, as described above.

With particular reference to FIGS. 5*d*-5*e*, each spacer 330 has a plurality of transverse rod members 344 with end portions 344*a* at either end for engaging connectors such as connectors 134 at one end and at the other connectors 234.

Connectors 134 and 234 when tightened by pushing or rotating them on rods 344, slightly compress the material of panels 117 and 114, resulting in the formation of a relatively rigid and geometrically stable unit where the panels 117 and 114 are held in a relatively rigid position relative to the spacers 330.

It will be noted in FIG. 5 that a plurality of spacers 330 are arranged in vertical substantially parallel orientation longitudinally spaced relation to each other, in only a single continuous bank, although more than one bank with shorter vertical length units 330 could be provided.

It will be noted that each spacer 330, like spacer 130, has a plurality of spaced substantially parallel rod members 346*a*, 346*b* and 346*b* (each like rods 146*a-e*) which are arranged in a grid and held and secured in an orthogonal orientation to a series of transverse rods 344. Rods 344 are secured to each of rods 346*a*, 346*b*, 346*c* preferably in a manner as described above, and in use in the panel unit will typically, but not necessarily, be substantially vertically oriented. The intersections between each of the rods 344 and rods 346*a-c* can be secured by known mechanisms, such as for example by spot welding, to provide an overall relatively rigid and stable structure. Additionally, reinforcement members 340 and 341 (which may be steel rebar, like reinforcement members 140) are also rigidly secured to rods 344 at intersections therewith, with known connections, such as for example, spot welding and the like. Thus, in spacers 330, the rebar members 340 and 341 form part of the rigid grid, which can be pre-fabricated at the manufacturing plant and then delivered to the construction site, either on its own or as part of the panel unit.

From FIG. 5*f*, it will be noted that a pair of horizontally oriented cells 347 are provided in each of the spacers 330, for receiving between a member 340 or 341, and a rod 346, a longitudinal reinforcement member 342 or 343, respectively. As cells 347 of the spacers 130 are aligned, members 342, 343 can be held in a longitudinal position, that is generally parallel to, but spaced apart from inner panel surfaces 114*b*, 117*b*. Spacers 330 may be used in the panel unit 312 with pre-installed vertical rebars for peripheral or double reinforcement of the reinforced concrete wall.

It will be appreciated that like in FIG. 4*a*, as shown in FIGS. 5*d-f*, a plurality of pairs of longitudinal reinforcement members 342, 343 can be held in vertical spaced relation in cells 347 created by the intersections of rod 346*b*, bar 340, and two rods 344 and at the intersections of rod 341, rod 346*c* and two rods 344. Rod 346*a* provides a spacing retaining element being in abutment with inner surface of the panel (like surface 114*b* of panel 114 in FIG. 5).

With reference to FIGS. 5*a*-5*c*, another alternate spacer 430 that can be used in the panel unit 312 as central or single reinforcement for the reinforced concrete walls is shown. It will be noted that each spacer 430, like spacer 330, has a plurality of spaced substantially parallel rod members 446*a*, 446*b*, 446*c*, which are arranged in an orthogonal orientation with a series of transverse rods 444 in a grid, as described above. Rods 444 are secured to each of rods 446*a-c* for example as described above, and in use in the panel unit will typically, but not necessarily, be vertically oriented. The intersections between each of the rods 444 and rods 446 can be secured by conventional means, such as by spot welding, to provide an overall relatively rigid and stable structure. Additionally, a reinforcement member 440 (which may also be like reinforcement members 140) are also rigidly secured to rods 344 at intersections therewith, with known connection mechanisms, such as for example, spot welding and the like. Thus, in spacers 430, members 440 are part of the rigid grid.

From FIG. 5*c*, it will be noted that longitudinally oriented cells 447 are provided in each of the spacers 430, and are formed between a pair rods 444, and a reinforcement member 440, and a rod 446*a*, for retaining one or more longitudinal reinforcement members 442. As cells 447 of the spacers 430 are aligned, members 442 can be held in a longitudinal position, that is generally parallel to, but spaced apart from inner panel surfaces 114*b*, 117*b*.

It will be appreciated that like in FIG. 4*a*, a plurality of longitudinal reinforcement members 442 can be held in a horizontal orientation while being in a spaced relation in a plurality of vertically separated cells 447 created at the intersection of bar 440 and rod 446, at each of the transverse rods 444. Additionally, it is possible to vertically stack a plurality of horizontally oriented reinforcement members 442 on top of each other in each retention cell.

With reference again to FIGS. 2*a* and 2*b*, two different connectors as discussed above, that can be employed with panel units 112 and 312, are illustrated; in particular connector 134 and connector 234. Connectors 134 include the cap member generally designated 136 and a bushing 138. Cap member 136 has its flange cap portion 135 secured to or integrally formed with a shaft portion 137 as shown in detail in FIGS. 3*a* to 3*c*. The shaft portion 137 has an end portion with a blind opening 137*a*, which provides for a threaded cylindrical inner receiving cavity 139 which through opening 137*a* can receive end portion 144*a* of a transverse rod 144, having a tooth shape end, by pushing the end portion into the blind opening 137*a*. If the tooth shape is spiraled, the connection can be provided by rotating the connector 136. Shaft portion 137 has a cylindrical lower portion outer surface 137*b*, with a conical end portion 137*c*, the lower portion being adapted to be received into the cavity 143 in the flange cap 141 of bushing 138.

With reference to FIGS. 2*a*, 2*b*, and 6*a*-6*c*, shaft portion 145 of bushing 138 has an end portion 145*d* with inwardly extending cantilever or tab portions 145*e*. Tab portions 145*e* are provided to help guide the end portion 144*a* of transverse rod 144 into proper alignment with shaft portion 145 of bushing 138, so rod end 144*a* can engage inner cavity 139 of shaft 137 of member 136. Tab portions 145*e* can also be configured such that when end 144*a* passes axially into cavity 151, it cannot be withdrawn in the opposite direction. This can be accomplished in several ways such as with a mechanism similar to a lock-washer. The tabs 145*e* can be resilient and angled inwardly towards the inner cavity 151. Thus rod end 144*a* can deflect the tabs when it moves into cavity 151; but reverse axial movement is prevented or inhibited by the angular positioning of the deflected tabs 145*e*. Additionally, a square cavity 135*b* is provided which has cross tool slots 135*a* at its base, which are provided in cap 135 to enable the connector 134 to be turned and tightened with an appropriate tool onto the end 144*a* of rod member 144.

During the assembly of a panel unit such as panel units 112, 312, each bushing 138 is placed onto the end portion 144*a* of a rod 144 and is moved so that the end of shaft portion 145 is brought into abutment with an abutment of some kind such as a rod (such as rod 146*a* identified in FIG. 4*c*). This will restrict movement of the bushing 138 axially onto the rod 144. Moreover, the end portion 145*d* and tab portions 145*e* hold the bushing 138 and can prevent any substantial withdrawal movement. This puts end portion 144*a* in an axially central position within cavity 151, and thus, bushing 138 can be mounted in co-axial alignment with rod 144. Thereafter, the perforated panel 117 can be placed with its inner surface 117*b* adjacent and against the surface 141 of the bushing 138 in co-axial orientation with its openings and cavity 151. Cap portion 136 has its shaft 137 fed into an opening in the polystyrene panel such that its shaft portion 137 enters into the opening 143 of the bushing 138. Through this opening 143, shaft 137 with its blind opening 137*a* leading to cavity 139, is moved towards rod end 144*a*. It should be noted that the diameter of the inner cavity 139 is less than the outer diameter toothed-shaped rod end 144 and the walls of the shaft member 137*b* are elastic enough to allow movement of the connector 136 towards rod end 144*a*. With this, the movement of the connector 136 can be rotational if tooth has a spiral shape or there is a threaded engagement or axial translation movement if the tooth has a plurality of independent circular shapes. In doing so, the body of shaft portion 137, which has a widened inner cavity portion at the end to permit more easy engagement, tightly engages the tooth shaped rod end 144*a*. Conical outer surface 137*c* of shaft 137 then comes into abutment with the tab portions 145*e*, which prevents any further movement of shaft 137 into cavity 151 of bushing 138.

Figure 8A:
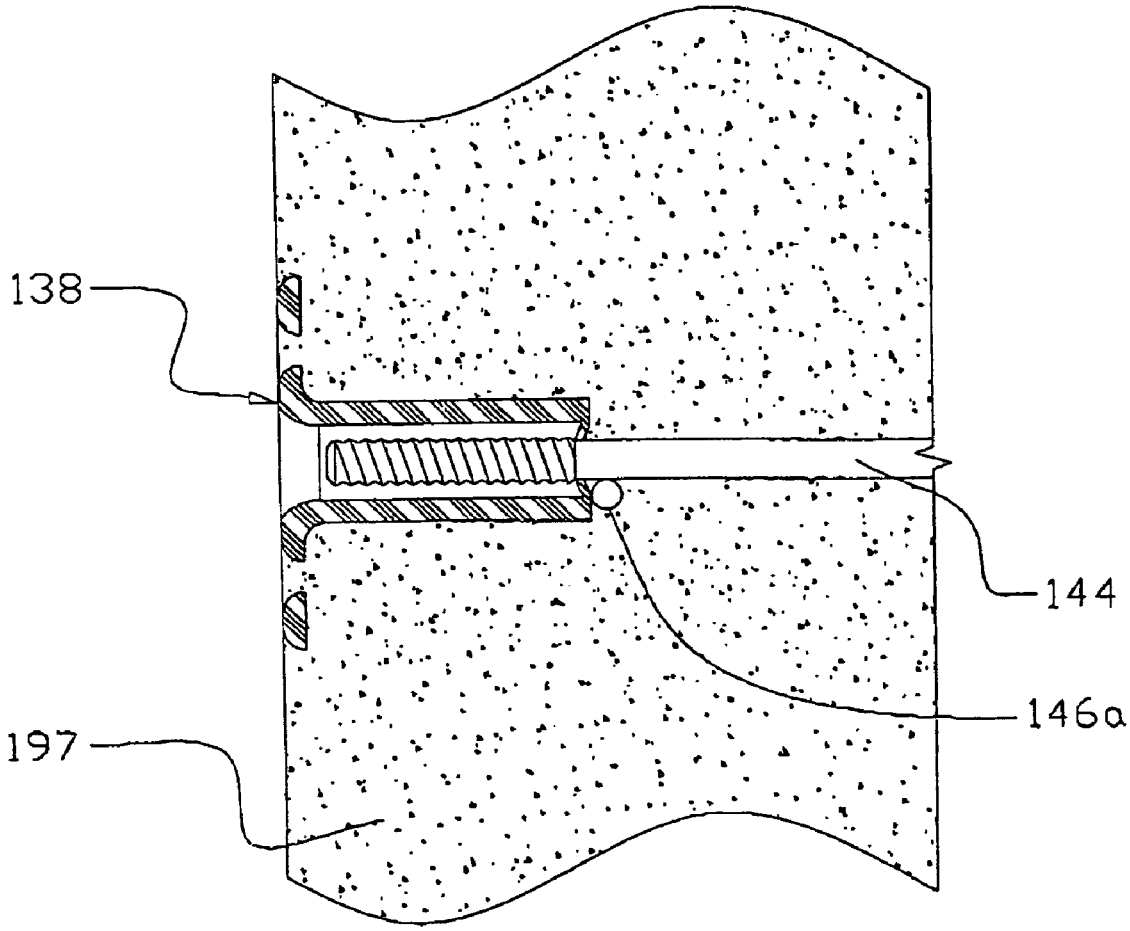
FIG. 8*a* is a top plan cross-sectional view of the bushing member of the connector of FIG. 8, remaining in situ after a concrete wall has been poured, with the cap member removed.

With reference now to FIG. 8, in a top plan cross-sectional view, the use with a panel 117 of a connector 134 as described above is shown in some detail, with the panel 117 thickness being held between the cap portion 141 of the spacer bushing 138 and the cap member 136. With reference to FIG. 8*a*, an enlarged view of part of a concrete wall 197 is shown which shows the bushing member 138 still remaining in place, secured in the concrete with the conical openings. The corresponding connector 136 has been removed by unscrewing of the connector from engagement with end 144*a* of rod 144. It will be appreciated that depending upon the type of connection of connector 136 to rod end 144*a*, it may in some embodiments not be possible, or at least easy, to disengage the connector 136. This would be the case where it is not desired to remove the panel held between the connector 136 and the bushing 138.

With reference to FIGS. 2*a*, 2*b* and 7*a* to 7*c*, another embodiment of a connector member is illustrated. It should be noted that connector member 234 has particular application for use with walls that will be covered with an outer coating of stucco. This is because connector 234 is especially adapted to cut a recess in the outer surface of the polystyrene panel 114 while connector 234 is being tightened on rod 144. The outer surface of the cap member 235 will become flush with, or slightly recessed below, the outer surface 114*a*, of panel 114. Connector member 234 with rib member 248 can generally be integrally formed and can be made of suitable hard plastic material such as polypropylene. Although not preferred, rib members could be made as a separate piece of material, possibly a different material and be interconnected to the rest of connector 234. Rib members 248 have a lower cutting edge that would be configured for cutting the polystyrene or other panel material during the tightening process.

Each connector 234 has a cylindrical shaft portion 237 with an inner cavity 239. The upper portion of shaft 237 is integrally joined to portion 235, which has a spherical outer surface and which in turn is itself integrally joined to cap portion 235. A blind opening 237*a* into a threaded cavity 239 provides a stepped opening, to provide for easier connection to the spiral end 144*a* of a rod 144. Additionally, a square cavity 235*b* is provided which has cross tool slots 235*a* at its base, which are provided in cap 235 to enable the connector 234 to be turned and tightened onto the end of a rod member 144. This configuration, like that of connector 134, helps ensure that the connectors 134, 234 can be removed even if the cavity is damaged during installation or in other ways.

With reference now to FIG. 9, a corner panel unit 512 which can be used in forming corner portions in reinforced concrete walls is illustrated. Panel unit 512 comprises outer panel members 514*a* and 514*b* oriented at right angles to each other. Likewise, inner panel members 517*a* and 517*b* are also mounted inside and spaced from panel members 514*a* and 514*b* respectively to provide a form space for a right angled reinforced concrete wall portion. Panel members 514*a*, 514*b* are preferably made from the same material as panel 114, as described above. Likewise, panel members 517*a*, 517*b* are preferably made from the same material as panel 117, as described above.

Outer angled connector plate members 516*b* with slots 519*b* are employed with connectors 534*b* which are like connectors 234 described above. Also, inner angled connector plate members 516*a* with slots 519*a* are employed in conjunction with connector members 534 which can be constructed like connectors 134 as described above. Likewise, spacers 530 can also be configured like spacers 130 as illustrated in FIGS. 4 and 4*a*. It will be appreciated how cells are formed by a pair of spaced vertical members 546 and a transverse member 544 (which are like members 146 and 144 described above) are able to support and contain a series of horizontal reinforcement members 542.

Panel units 512 can be used in conjunction with, and connected to, panel units 112 to provide reinforced concrete walls having portions which are oriented at an angle to each other such as at 90°. Appropriate corresponding changes to the angles of the brace members could be made in such embodiments. It should be noted that panel unit 512 can be configured for any corner of the concrete wall. It can be provided with connector plate members 516*a*, 516*b* bent at the required angle. Also, the ends of panel members 514*a*, 514*b*, and 517*a*, 517*b* should be configured with an appropriate angle to provide a suitable joint connection. In alternate embodiments, instead of slots 519*a*, 519*b*, suitably sized openings can be provided through which the shaft portion of a connector can pass through. In other embodiments, connector plate member 516*b* could be configured to be mounted adjacent the inner surfaces of panels 514*a*, 514*b*, with the slots fitted onto appropriately configured transverse rods 544, between the inner panel surfaces and the vertical rod members 546*a*. Likewise, the connector plate member 516*a*, could be configured and be mounted with slots receiving transverse rods 544, between the inner surfaces of panels 517*a*, 517*b* and the adjacent vertical rods, like rod 546*e* shown in FIG. 9. It should however, be noted that providing the connector plate members at the inner surfaces of the panels, would not provide a uniform flat finish on the surface of the poured concrete wall.

Figure 10:
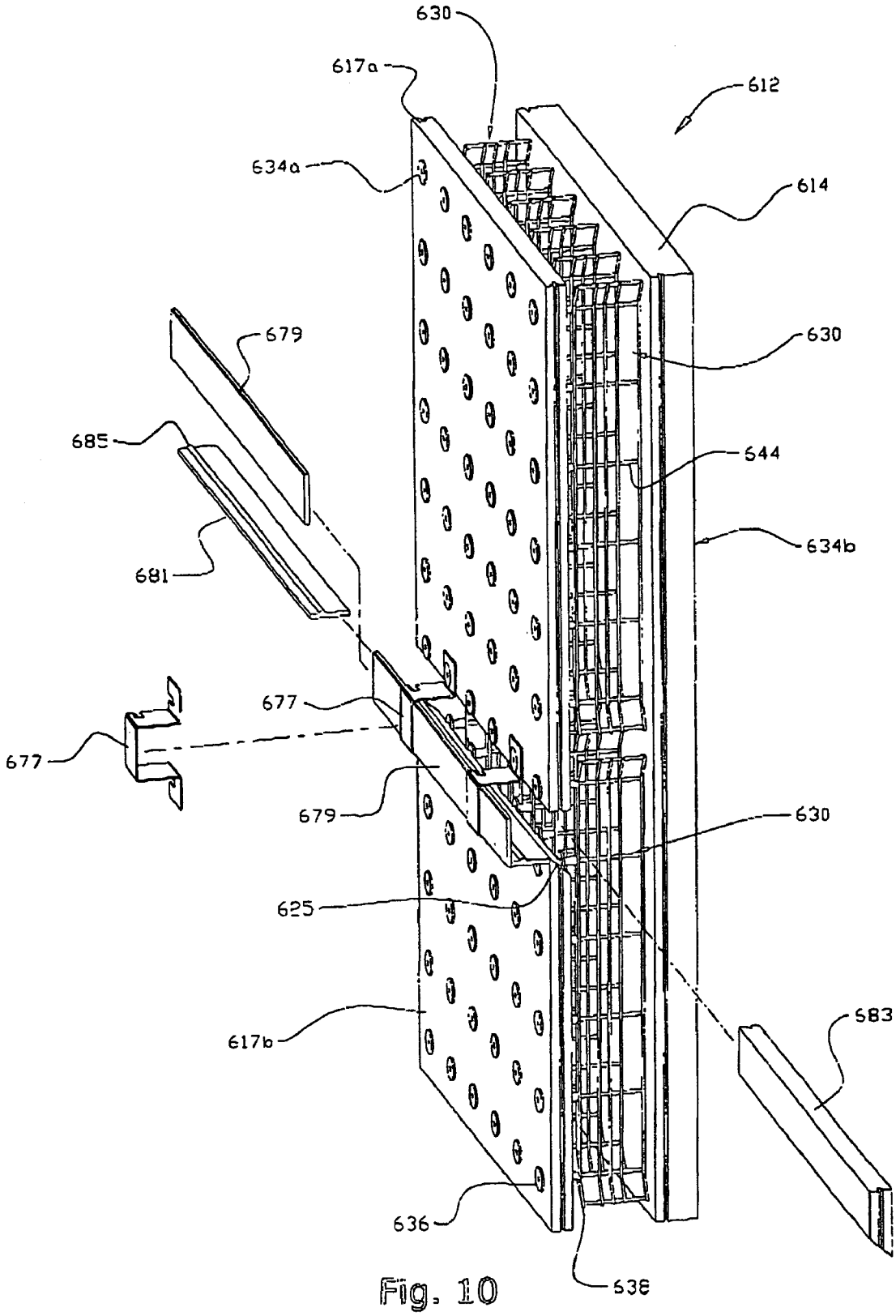
FIG. 10 illustrates a panel unit with some components exploded away that can be employed in the panel unit of FIG. 4, 4*a*, 5 to produce a reinforced concrete wall of FIG. 11 with a ledge portion.

With reference now to FIG. 10, a modified panel unit 612 is illustrated. Panel unit 612 is suitable for forming a reinforced concrete wall having one surface formed with a transverse, longitudinally extending but integrally formed ledge. Panel unit 612 is quite similar to panel unit 112 illustrated in FIGS. 4 and 4*a*. Panel unit 612 comprises a first upstanding panel member 614 like panel 114 and preferably made from polystyrene or other expanded foam plastic product. Spaced apart and in generally planar parallel relation to panel member 614 is a panel 617. Panel 617 is like panel 117 above and preferably made from a relatively rigid material such as plywood, OSB, particle board or the like.

Spacers 630 which can be like spacers 130 as illustrated in FIGS. 4, 4*a* to 4*e* have transverse rod members 644 like rod members 144, with extension portions, which connect with connectors 634*a* (which can be like connectors 134) for panels 617, and connectors 634*b* (which can be like connectors 234) in a manner similar to that described above.

It will be noted that panel members 617 each has a longitudinal strip portion 683 removed therefrom. This could be removed at the building site or factory, or the panel unit could alternately be pre-fabricated without the portion 683. It should be noted that panel member portion 683 is formed at an angle such that the lower surface of lower portion 617*b* has an angled upper surface 625.

Secured to the panel 617 by way of bracer members 677 are a horizontal ledge base form member and 681 vertical ledge base form member 679, that together provide a generally L-shaped form. Bracer members 677, like plate connectors 516*a*, 516*b* in FIG. 9, have slots which can receive the shaft of a connector 634*a*. In alternate embodiments, instead of slots, suitably sized openings can be provided through which the shaft portion of a connector can pass through. In other embodiments, brace member 677*s* could be configured to be mounted adjacent the inner surfaces of panels 617*a*, 617*b*, with the slots fitted onto appropriately configured transverse rods 644, between the inner panel surfaces and the vertical rod members 546*a*, although this would not provide such a flat finish on the surface of the concrete wall. Horizontal ledge form member 681 can have a rib 685 longitudinally extending on the upper surface thereof to form the groove which will prevent dripping of water from the atmosphere onto the vertical surface of the lower panel 617*b*. Vertical ledge form member 679 and horizontal ledge form member 681 are held in position in relation to panel 615 by the pair of spaced bracer members 677. Members 679 and 681 could be integrally formed as one member. Members 679 and 681 are typically made from plywood, but other materials can also be used.

It should be noted that it is not necessary to provide an upper horizontal ledge form member as during the pouring process the concrete will harden quickly enough during the pouring process so that the upper horizontal ledge form member is not necessary.

Figure 11:
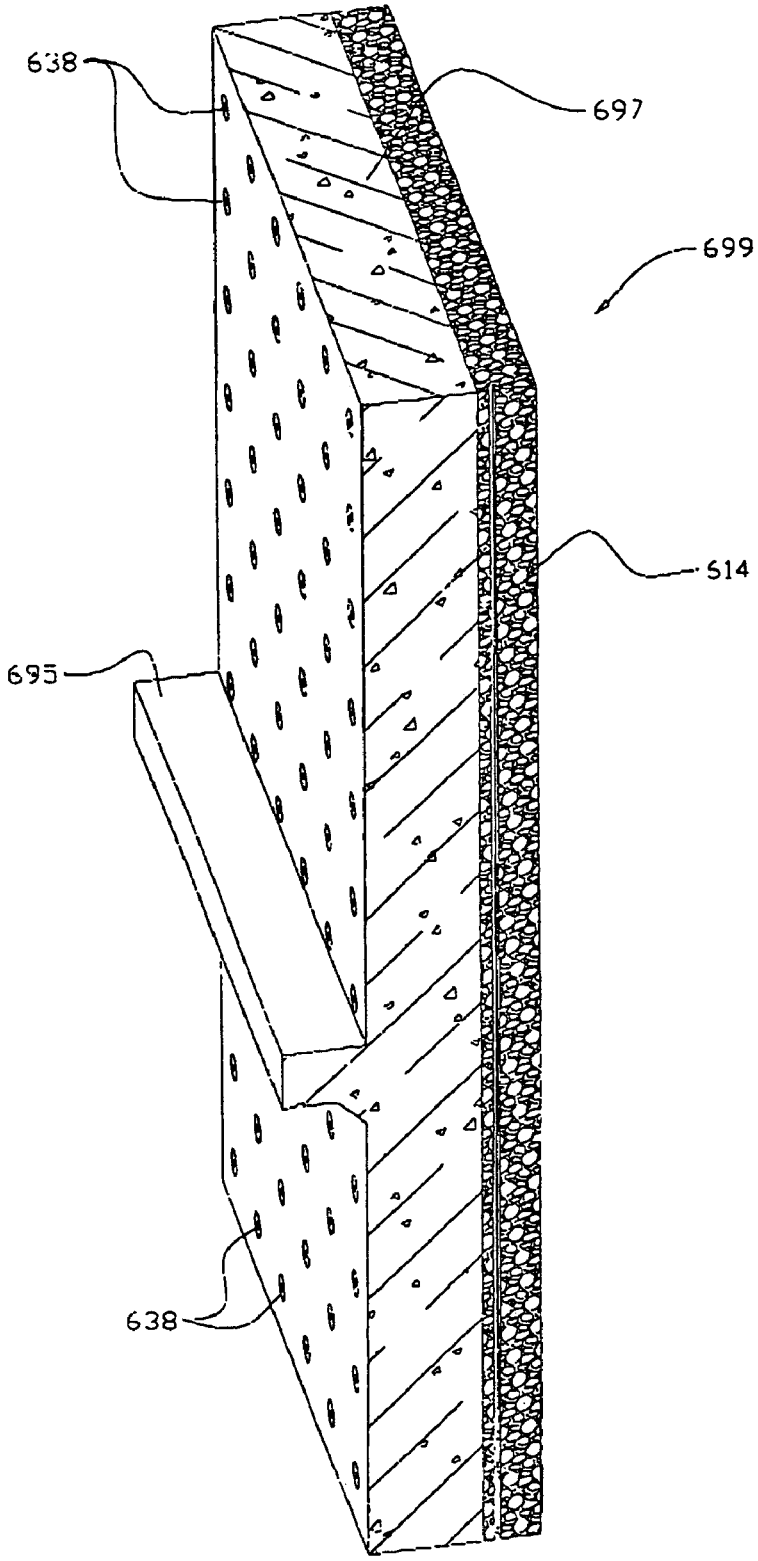
FIG. 11 is a perspective view of a reinforced concrete wall segment as shown at 10D in FIG. 1, produced with the panel unit of FIG. 10, with open concrete surface added thereto.

With reference now to FIG. 11, a finished reinforced concrete wall section 699 is illustrated. It will be noted that concrete wall 699 includes the concrete wall portion 697 with an inner insulating panel 614 still in place. However, outer cap members 636 (like caps members 136) can be removed by unscrewing them from engagement with transverse rods 644. Polystyrene panel 617*a*, 617*b*, bracer members 677 and boards 679, 681 are can thus be removed. Only the spacer members 638 (like members 138) remain in place. The top surface of spacer members 638 are substantially flush with the outer surface of the concrete 697. Additionally, ledge 695 has been integrally formed with the rest of the concrete wall portion 697.

Figure 12A:
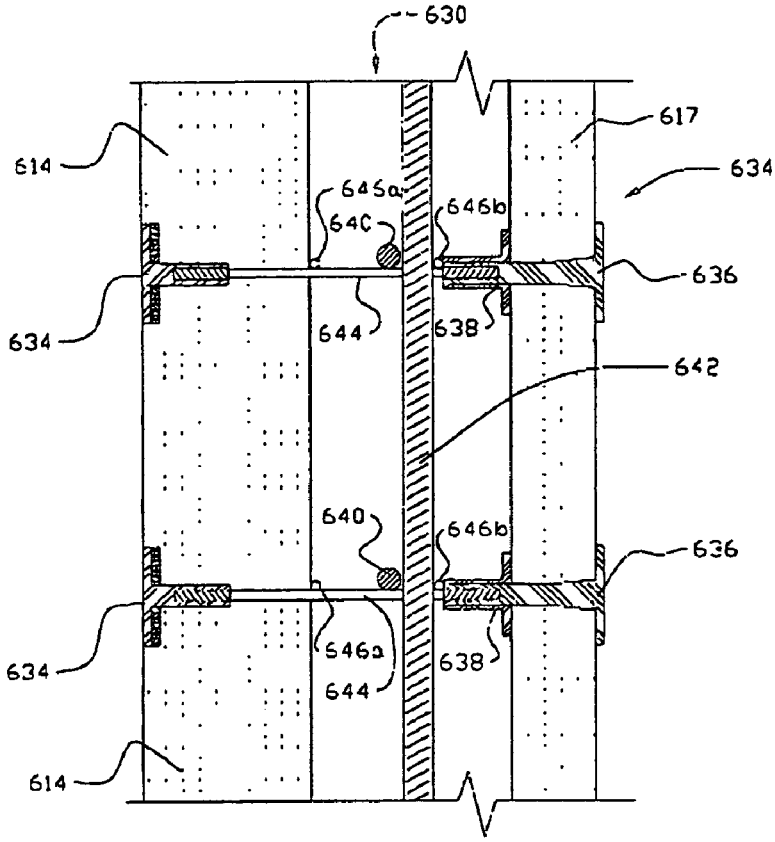
FIG. 12*a* is a top cross-sectional plan view of a portion of a panel unit that may be employed to produce reinforced concrete wall segments 10B, 10C and 10D as shown in FIG. 1 with panel unit similar to FIG. 5 with a spacer of FIG. 5*a* in accordance with an example embodiment of the invention.

With reference now to FIG. 12*a* in a top cross-sectional view the upper portion of a segment of panel unit 612 is shown which is like panel unit 312 in FIG. 5, but which employs spacers 630 like spacers 430 in FIGS. 5*a*-5*c*. The positioning of the connectors 634 comprising cap member 636 and bushing 638 and connector member 634*b* which are like connectors 234 described above is shown. A horizontal reinforcement member 642 and a pair of vertical reinforcement members 640 are illustrated along with vertical rod members 646 of the spacers 630. Vertical rebar is held in a retention cell formed between reinforcement member 640 and rod 646*b* and two rods 644. Vertical rod 646*a* is in abutment with the inner surface of panel 614 and acts as a part of a spacer mechanism as described above.

Figure 12B:
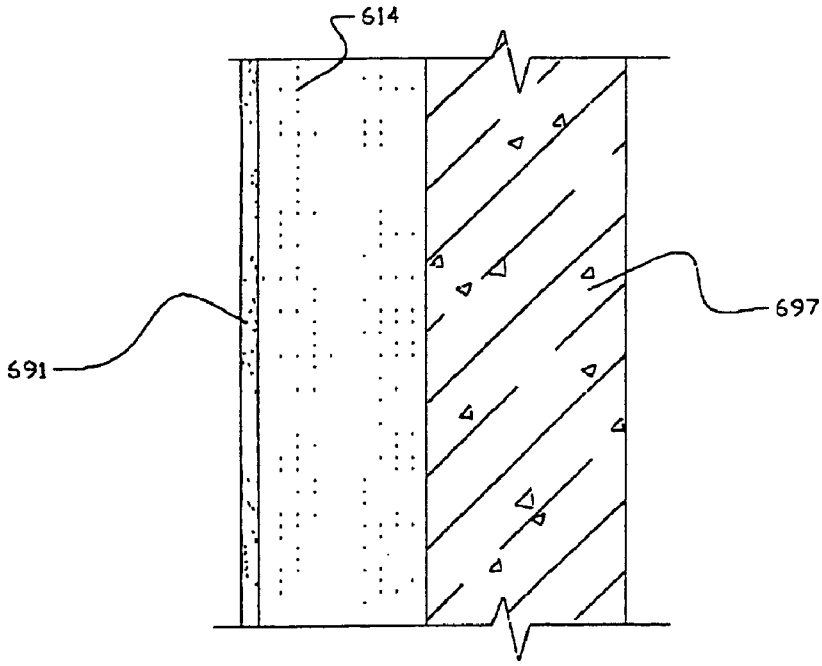
FIG. 12*b* is a top cross-sectional plan view of a portion of a concrete wall produced with the panel form unit of FIG. 12*a*, with a finished surface of polystyrene board added thereto as shown at segment 10B in FIG. 1.

In FIG. 12*b*, once the concrete has been poured and allowed to harden, the concrete wall portion 697 is formed and the panel 617 can be removed along with connector cap members 636, as described above. Once connectors 634 and polystyrene board 617 is removed, the concrete surface on one side of the wall is exposed.

Also, in conjunction with panel 614 an outer finishing material such as stucco 691 is shown affixed to what would typically be the outside surface of the wall. The wall portion illustrated in FIG. 12*b* is shown as part of the wall structure in FIG. 1 as wall section 10B, 10C.

Figure 13A:
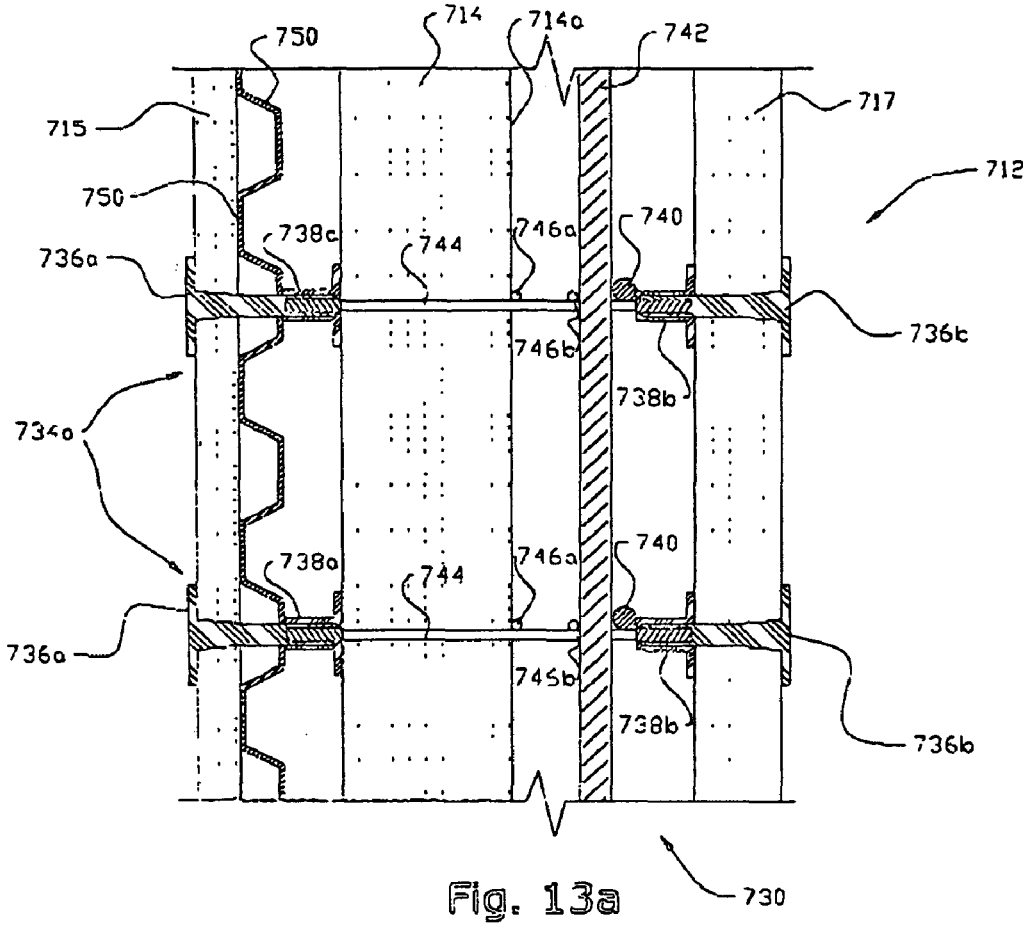
FIG. 13*a* is a top cross-sectional plan view of a portion of a panel unit that may be employed to produce a reinforced concrete wall segment shown as 10A in FIG. 1 in accordance with another embodiment of the invention.
Figure 13B:
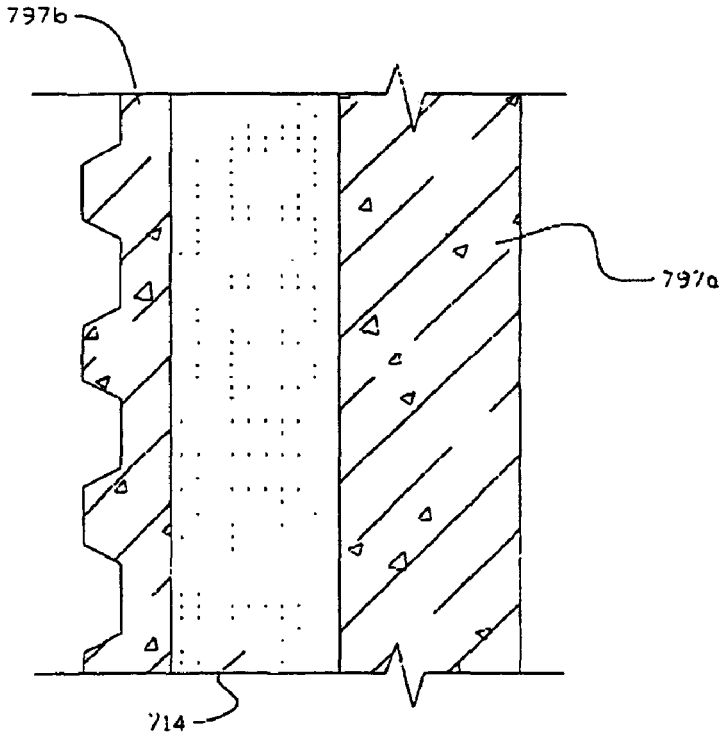
FIG. 13*b* is a top cross-sectional plan view of a portion of a concrete wall produced with the panel form unit of FIG. 15*a;*

With reference now to FIG. 13*a*, in a top cross-sectional view, the upper portion of a segment of panel unit 712 is illustrated. The configuration and arrangement of panel unit 712 is somewhat similar to that of panel unit 612, but employs in the system, an inner panel 717 (which can be like panel 117), a spaced medial panel 714 (which can be like panel 114), and an outer panel 715 (which can also be made like panel 117). Connectors 734*a* are similar to connectors 134, and comprise cap member 736*a* and bushing 738*a*, which are used to connect panel 714 to the spacer. However, bushing 738*a* is configured so that it can be used in a reverse axial configuration to the way bushing 138 is used with cap member 136. This is done by providing the mating engagement of the shaft of connector 736*a*, with the bushing 738*a* in the vicinity of the cap portion. In this way the flange member of bushing 738*a* abuts the inner face of panel 714 and the end of shaft portion (like portion 145 of bushing 138) abuts the surface of a corrugated panel member 750. Preferably, the panels 715 and 717 comprise polystyrene boards and have laminated films on at least the inner surfaces, preferably made of a plastic film material such as polypropylene. Although form panel liner 750 is shown with a plurality of vertically extending channels, other contour patterns, shapes and surface textures can be employed to provide variations in finished surfaces.

Corrugated panel member 750 is typically made from a relatively strong plastic material such as ABS alloy or HIPS alloy and preferably has a thickness in the range of 1-3 mm. It should be noted a similar embodiment only employs Expanded Polypropylene (EPP) boards with a corrugated surface instead of a combination from boards 717 and 750. It should be noted that the untreated surface of an EPP board is relatively easy to detach from a concrete wall, without causing damage to the wall, and leaves a relatively smooth surface. EPP boards also can be readily pre-formed in a mold to provide a desired contoured surface.

Panel member 750 also has a plurality of appropriately spaced apertures that permit shaft of cap member 736*a* to pass therethrough and into the interior cavity of bushing 738*a* so as to engage an end of a transverse rod member 744 (which is like rod member 144). The outer surface has peaks, which will engage the inner surface of panel 715.

As shown in FIG. 13*a*, panel unit 712 also has a panel 717, which is connected to the opposite ends of rods 744 using connectors with cap members 736*b*, and bushing 738*b*, which are configured in the same way as connectors 134 as described above.

Spacer 730 is formed as a grid similar to spacer 430 in FIG. 5*a* employing a series of spaced transverse rod members 744 joined to a pair of spaced vertical rod members and to a vertical reinforcement bar (like bar 440), which is also spaced from the rods. A retaining cell is thus provided between a rod 744 on the bottom and by a rod 746*b* and bar 740 (and between two transverse rods 744—only one of which is shown in FIG. 13*a*) for a longitudinal (typically horizontal) reinforcement bar 742. Vertical rods 746*a* act as part of a spacing mechanism abutting against an inner surface 716*a* of panel 716.

It will be appreciated that when connectors 736*a* and 736*b* are tightened on rods 744, the components are generally compressed in a transverse direction. Panel 715 may be compressed to some extent between the flange of cap member 736*a* and the peaks of panel member 750. Panel 714 is compressed between flange of bushing 738*a* and a rod member 746*a*. Additionally, panel 717 is compressed between the cap of cap member 736*b* and the flange of bushing 738*b*. The overall effect is that a relatively rigid and stable panel unit 712 is formed which can be used in a form systems to create a reinforced concrete wall with a decorative outer surface and an internal insulating panel, as shown in FIG. 13*b*.

It should be noted that the wall segment of FIG. 13*b* is illustrated at 10A in FIG. 1. Panel 717, form liner panel 750 and panel 715 have all been removed, along with cap members 736*a* and 736*b*, which has been unscrewed, and the concrete surfaces on the both sides of the wall are exposed. Typically the apertures remaining into the cavities of bushings 738*a* would be sealed with conventional sealing materials such as grout with fiberglass or liquid glass.

Two concrete walls are actually formed, with wall 797*a* providing the structural strength and wall 797*b* acting to provide an aesthetically pleasing appearance, and also providing the other side of the "sandwich" so as to isolate insulating panel 714.

Figure 14A:
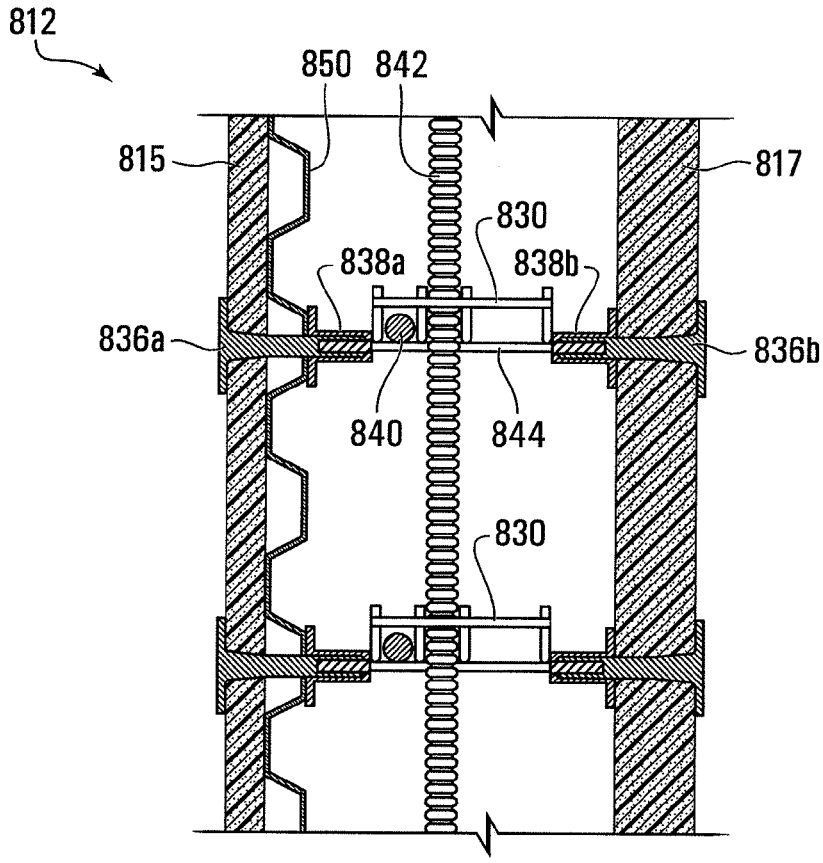
FIG. 14*a* is a top cross-sectional plan view of a portion of a panel unit that may be employed to produce a reinforced concrete wall segment 10E in FIG. 1 in accordance with another embodiment of the invention; and, FIG. 14*b* is a top cross-sectional plan view of a portion of a concrete wall produced with the panel form unit of FIG. 14*a*.

Finally, with reference to FIG. 14*a*, in a top cross-sectional view the upper portion of a segment of panel unit 812 is illustrated. The configuration and arrangement of panel unit 812 is somewhat similar to that of panel unit 112, but does not employ in the system a panel 114. It does however include spaced apart panels 815 and 817, and can made into a panel unit like panel 712, as described above. Additionally, a form liner 850 like form liner 750 as described above can be employed as shown. Connectors 834*a*, 834*b* are like connectors 134, and comprising cap members 836*a*, and bushing 838*a*, 838*b*, respectively. Panel member 850 abuts with panel 815 and bushings 838*a*.

Corrugated panel member (form liner) 850 can be made like panel 750 above, and also has a plurality of appropriately spaced apertures that permit shaft of cap member 836*a* to pass therethrough and into the interior cavity of bushing 838*a* so as to engage an end of a transverse rod member 844 (which is like rod member 144). The outer surface has peaks, which will engage the inner surface of panel 817.

As shown in FIG. 14*a*, in top view a spacer 830 (which is like spacer 130 in FIGS. 4*b*-4*e*), where retaining cells provide positioning the vertical and horizontal reinforcement bars 840 and 842.

It will be appreciated that when connectors 836*a* and 836*b* are tightened on rods 844, the components are generally compressed in a transverse direction. Panel 815 may be compressed, at least to some extent, between the flange of cap member 836*a* and the peaks of panel 850. Panel 817 is compressed between the cap of cap member 836*b* and the flange of bushings 838*b*. The overall effect is that a relatively rigid and geometrically stable panel unit 812 is formed which can be used in a form systems to create a reinforced concrete wall with a decorative concrete surface as shown in FIG. 14*b*.

Figure 14B:
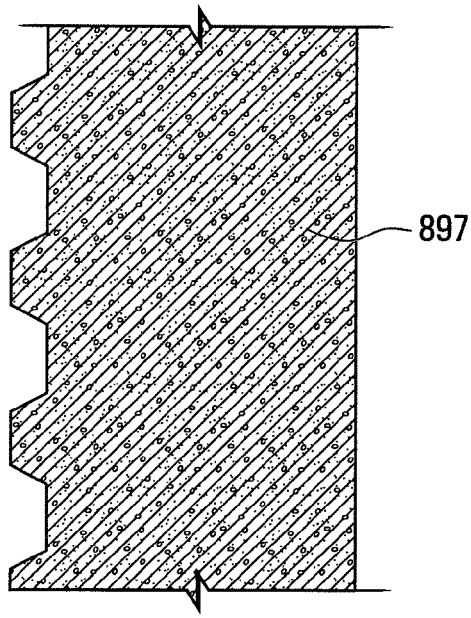

In FIG. 14*b*, the wall 897 is shown after the concrete has been poured and hardened, with connectors 836*a* and 836*b*, polystyrene boards 815 and 817, and plastic form liner 850 all removed. The concrete surface on both sides of the wall is exposed. It should be noted that the wall segment of FIG. 14*b* is illustrated at 10E in FIG. 1. Typically the apertures remaining bushings 838*a* would be sealed with conventional sealing materials such as grout as described above.

Although the present invention has been described with reference to certain embodiments, other embodiments are possible. Therefore, the spirit and scope of the present invention should not be limited to the description of the embodiments contained herein.

I claim:

1. A panel unit for use as part of a concrete form, said panel unit comprising:

(i) first and second spaced apart longitudinally oriented foam plastic panel members defining a form space there between;

(ii) a spacer comprising at least one transverse tie rod member secured to and extending between said first and second panels, said transverse tie rod member having a first end adapted to be secured to a first connector for connecting said transverse tie rod member to said first panel member;

wherein said first connector comprises a connector assembly for use in securing said first panel member to a transverse tie member, said connector assembly comprising:

(a) a cap member having a flange cap portion and a shaft portion, said shaft portion with an end having an opening adapted to be interconnected to an end portion of a tie member; and (b) a bushing member having a flange portion and an axially aligned shaft portion with an end opposite to said flange portion, said bushing member having a continuous cavity formed in and passing through said flange portion and said shaft portion;

said shaft portion of said cap member being receivable axially into said continuous cavity of said bushing member through said flange portion toward said end of said shaft portion for releasable engagement with said end of said tie member extending through said end of said bushing member into said continuous cavity; and said flange portion of said bushing having at least one aperture passing there through, said aperture and having an opening for permitting the fluid communication of flowable concrete into said aperture, said aperture being configured such that when concrete flows into and hardens in said aperture, said hardened concrete in said aperture of said bushing member which is integrally connected to hardened concrete outside of said aperture of said bushing member provides an anchoring device to hold said bushing member in said hardened concrete.

2. A panel unit as claimed in claim 1, wherein said at least one aperture in said flange of said bushing member is configured in a generally conical shape, with a base of said conical shape of said at least one aperture being positioned in contact with said inner surface of said first panel member.

3. A panel unit as claimed in claim 1, wherein said cap member is made from a plastic material.

4. A panel unit for use as part of a concrete form for a concrete wall, said panel unit comprising:

(a) first and second spaced apart longitudinally oriented foamed plastic panel members having inner surfaces laminated with a plastic film and defining a form space there between; said panel members having respective outer opposed surfaces;

(b) a spacer comprising at least one transverse tie member secured to and extending between said first and second panel members, said transverse tie member having a first end being adapted for securing said transverse tie member to a first connector to mount said spacer to first panel member, said transverse tie member having a second end being adapted for securing said transverse tie member to a second connector to mount said spacer to said second panel member; said first connector being operable to be released from said first panel member to assist in facilitating the removal of said first panel member from said tie member;

and wherein said first connector comprises a connector assembly for use in securing a panel member to said spacer with said transverse tie member, said connector assembly comprising:

(i) a cap member having a flange cap portion and a shaft portion, said shaft portion with an end having an opening adapted to be interconnected to an end portion of said tie member; and (ii) a bushing member having a flange portion and an axially aligned shaft portion with an end opposite to said flange portion, said bushing member having a continuous cavity formed in and passing through said flange portion and said shaft portion, said shaft portion of said cap member being receivable axially into said continuous cavity of said bushing member through said flange portion toward said end of said shaft portion so as to be able to engage said end of said transverse tie member extending through said end of said bushing member into said continuous cavity wherein said first panel member is held between said flange portion of said cap member and said flange portion of said bushing member and wherein said cap member is axially moved toward said transverse tie member, such that a panel member is compressed between said flange portion of said cap member and said flange portion of said bushing member to provide a rigid connection between said connector assembly, said first panel member and said transverse tie member.

5. A panel unit as claimed in claim 4, wherein said second end of said transverse tie member is held within said second panel member between said inner and outer surfaces such that said second panel member is held in a stable position relative to said spacer.

6. A panel unit as claimed in claim 4 wherein said first panel member has an inner surface facing an inner surface of said second panel member, and an opposite outer surface, and wherein said second panel member has an outer surface disposed opposite to said inner surface of said second panel member and wherein said inner and outer surfaces of at least said first panel member with a suitable plastic film having non-adhesive properties and that is laminated to both said inner surface and said outer surface of said first panel member, and wherein said shaft portion of said cap member is displaceable relative to said bushing member whereby said first panel member is compressed between said flange portion of said cap member and said flange portion of said bushing member.

7. A panel unit for use as part of a concrete form for a concrete wall, said panel unit comprising:

(a) a first and second spaced apart longitudinally oriented foamed plastic panel members each of said first and second panel members having inner surfaces laminated with a plastic film and defining a form space there between;

(b) a spacer comprising at least one transverse tie member secured to and extending between said first and second panel members, said transverse tie member having a first end being adapted for securing said transverse tie member to a first connector to mount said spacer to first panel member, said transverse tie member having a second end being adapted for securing said transverse tie member to a second connector to mount said spacer to second panel member said first connector being releasable from said transverse tie member to assist in facilitating the release of said first panel member from said tie member;

wherein said first connector comprises a connector assembly for use in securing said first panel member to a transverse tie member, said connector assembly comprising:

(i) a cap member having a flange cap portion and a shaft portion, said shaft portion with an end having an opening adapted to be interconnected to an end portion of a tie member;

(ii) a bushing member having a flange portion and an axially aligned shaft portion with an end opposite to said flange portion, said bushing member having a continuous cavity formed in and passing through said flange portion and said shaft portion;

said shaft portion of said cap member being receivable axially into said continuous cavity of said bushing member through said flange portion toward said end of said shaft portion for releasable engagement with said end of said tie member extending through said end of said bushing member into said continuous cavity; and said flange portion of said bushing having at least one aperture passing there through, said aperture and having an opening for permitting the fluid communication of flowable concrete into said aperture, said aperture being configured such that when concrete flows into and hardens in said aperture, said hardened concrete in said aperture which is integrally connected to hardened concrete outside of said aperture provides an anchoring device to hold said bushing member in said hardened concrete.

8. A panel unit as claimed in claim 7, wherein said at least one aperture in said flange of said bushing member is configured in a generally inwardly directed generally conical shape.

9. A panel unit for use as part of a concrete form for a concrete wall, said panel unit comprising:

(a) first and second panel members being made from foamed plastic and spaced apart in a transverse direction to define a form space there between, said first panel member having an inner surface facing an inner surface of the second panel member; said first and second panel members each having outer surfaces, each of said outer surfaces being opposed to respective said inner surfaces of said first and second panel members; said inner surface of said first panel member having non-adhesive properties in relation to hardened concrete held in said form space;

(b) a spacer transversely disposed between said first and second panel members and holding said panel members in generally spaced parallel relation to each other, said spacer comprising:

(i) first and second spaced transverse tie members oriented generally in a transverse direction and each having a first end and an opposite second end, each said first end being adapted for securing said respective transverse tie member to a respective first connector mounted to said first panel member, and each second end being adapted for securing said respective transverse tie member to a respective second connector mounted to said second panel, said connectors mounted to said first panel being adapted to be removed from said tie members from said outer surface when said form space is filled with concrete;

(ii) first and second spaced rod members oriented generally orthogonal to said transverse direction and said first and second rod members being secured to and extending between said first and second tie members, said first and second rod members being in generally spaced, parallel and planar relation to each other, wherein said first rod member is in abutting relation with each of said first connectors and second rod member abuts with the inner surface of the said second panel member;

wherein said first and second connectors are connected to said first and second tie members such that said first and second panel members are held in slight compression between first and second rod members and the respective first and second connectors, resulting in the formation of a rigid panel unit wherein the said panels are held in a substantially rigid position relative to the said spacer.

10. A panel unit as claimed in claim 9 wherein said second connectors have outer surfaces that do not protrude beyond the outer surface of the second panel member.

11. A panel unit as claimed in claim 9 wherein at least said inner surface of said first panel member is made from said foam plastic laminated with a plastic film, wherein said plastic film will tend not to bond extensively to hardening or hardened concrete.

12. A panel unit for use as part of a concrete form for a concrete wall, said panel unit comprising:

(a) a first panel member made from a foamed plastic having an inner surface and an opposed outer surface said inner surface of said first panel member having non-adhesive properties in relation to hardened concrete held in said form space and said inner surface being laminated with a suitable plastic film;

(b) a second panel member made from a foamed plastic and spaced apart in a transverse direction to define a form space between said first panel member and said second panel member, said inner surface of said first panel member facing an inner surface of said second panel member;

(c) a spacer generally being transversely positioned between said first and second panel members, said spacer holding said first and second panel members in generally transversely spaced relation to each other, said spacer comprising:

(i) a transverse tie member having a first end and an opposite second end, said first end being adapted for securing said transverse tie member to a first connector mounted to said first panel member and said second end being adapted for securing said transverse tie member to a second connector mounted to said second panel member;

(ii) first and second rod members interconnected to and oriented generally orthogonally to, said transverse tie member;

wherein said second connector, said transverse tie member and said second rod member are configured such that said second panel member is held in compression between and by the interaction of said second connector and said second rod member thereby holding said second panel in a rigid or semi-rigid position relative to said spacer.

13. A panel unit as claimed in claim 12 wherein said transverse tie member comprises a first tie member and said panel unit further comprises a second transverse tie member having a first end and an opposite second end, said first end of said second transverse tie member being adapted for securing said second transverse tie member to a third connector mounted to said first panel member and said second end being adapted for securing said second transverse tie member to a fourth connector mounted to said second panel member;

wherein said first and second rod members are interconnected to said second transverse tie member, wherein said fourth connector, said second transverse tie member and said second rod member are configured such that said second panel member is held in compression between said fourth connector and said second rod member.

14. A panel unit for use as part of a concrete form for a concrete wall, said panel unit comprising:

(a) first and second panel members being made from a foamed plastic and spaced apart in a transverse direction to define a form space there between, said first panel member having an inner surface facing an inner surface of said second panel member; said first and second panel members each having outer surfaces, each of said outer surfaces of said first and second panel members being opposed to respective said inner surfaces of said first and second panel members;

(b) a spacer transversely disposed between said first and second panel members and holding said first and second panel members in generally transversely spaced relation to each other, said spacer comprising:

(i) at least one transverse tie member oriented generally in a transverse direction and having a first end and an opposite second end, said first end being connected to a first connector mounted to said first panel member and said second end of said being connected to a second connector mounted to said second panel member;

(ii) first and second spaced rod members oriented generally orthogonal to said transverse direction and said first and second rod members being secured to said at least one tie member, said first and second rod members being in generally spaced, parallel and planar relation to each other, wherein said first rod member is in abutting relation with said first connector and second rod member abuts with the inner surface of the said second panel member positioning said second panel orthogonally to said tie member;

wherein said first and second panel members are held in compression by the interaction of said spacer and each of said first and second connectors respectively to assisting in providing a substantially rigid panel unit.

15. A panel unit for use as part of a concrete form for a concrete wall, said panel unit comprising:

(a) first and second panel members being made from a foamed plastic and spaced apart in a transverse direction to define a form space there between, said first panel member having an inner surface facing an inner surface of said second panel member; said first and second panel members each having outer surfaces, each of said outer surfaces of said first and second panel members being opposed to respective said inner surfaces of said first and second panel members; said inner surface of said first panel member having non-adhesive properties in relation to hardened concrete held in said form space;

(b) a spacer transversely disposed between said first and second panel members and holding said first and second panel members in generally transversely spaced relation to each other, said spacer comprising:

(i) at least one transverse tie member having a first end and an opposite second end, said first end being adapted for securing said transverse tie member to a first connector mounted to said first panel member and a second connector secured to said second end of said at least one transverse tie member, said first connector being adapted to be removed from the tie member from said outer surface when said form space is filled with hardened concrete, wherein said first end of said tie member being located within close proximity of the said inner surface of said first panel member and having non-adhesive properties against the hardened concrete, and the second end of said tie member is positioned between the inner and outer surfaces of said second panel member;

(ii) first and second spaced rod members oriented generally orthogonal to said transverse direction and said first and second rod members being secured to said at least one tie member, said first and second rod members being in generally spaced, parallel and planar relation to each other, wherein said first rod member is in abutting relation with said first connector and second rod member abuts with the inner surface of the said second panel member positioning said second panel orthogonally to said tie member;

wherein said first and second connectors are connected to said at least one transverse tie member such that said first and second panel members are held in slight compression between first and second rod members and the respective first and second connectors, resulting in the formation of a substantially rigid panel unit wherein the said panels are held in a substantially rigid position relative to the said spacer.

16. A panel unit as claimed in claim 15 wherein said first connector comprises a connector assembly, said connector assembly comprising:

(a) a cap member having a flange cap portion and a shaft portion, said shaft portion with an end having an opening adapted to be interconnected to said first end portion of said tie member; and (b) a bushing member having a flange portion and an axially aligned shaft portion with an end opposite to said flange portion, said bushing member having a continuous cavity formed in and passing through said flange portion and said shaft portion;

said shaft portion of said cap member being receivable axially into said continuous cavity of said bushing member through said flange portion toward said end of said shaft portion for releasable engagement with said end of said tie member extending through said end of said bushing member into said continuous cavity and said end of said bushing member having guide members depending inwardly to guide said first end of said tie member into axial alignment with said opening in said cap portion, said shaft portion of said cap member having a length sufficient such that said cap member can co-operate with said bushing member to provide compression of said first panel member.

17. A panel unit as claimed in claim 15 wherein said inner surfaces of both of said first and second panel members are laminated with a suitable plastic film material to prevent adhesion with concrete so that both said first and second panel members can be removed when said concrete has hardened and re-used as a panel unit as a part of another concrete form.

18. A panel unit as claimed in claim 15 wherein said first connector comprises a connector assembly for use in securing a panel member to said spacer with said transverse tie member, said connector assembly comprising:

(a) an outer member having an outer retaining portion and a shaft portion, said shaft portion with an end having an opening adapted to be interconnected to said end portion of said tie member; and (b) a bushing member positioned proximate an inner surface of said first panel member between said first panel member and said second panel member, said bushing member having an axially aligned shaft portion with a first end having proximate thereto a stopping portion, and said shaft portion having an second end opposite to said first end, said bushing member having a continuous cavity formed in and passing through said shaft portion extending from said first end to said second end;

said outer retaining portion of said outer member holding said first panel member when subjected to outward forces and said shaft portion of said outer member being receivable into said first panel member axially into said continuous cavity of said bushing member from said first end to said second end of said shaft portion so as to be able to engage said end of said tie member extending through said second end of said bushing member into said continuous cavity, said shaft portion of said outer member also engaging an abutment in said continuous cavity of said bushing member so to limit the compression of said panel member by limitation of the extent of axial movement of said shaft portion of said outer member relative to said bushing member toward said second end of said shaft portion of said bushing member;

whereby said first panel member is held in compression between said outer member and said stopping portion of said bushing member.

19. A panel unit as claimed in claim 15 wherein said second connector has a cap portion with an outer surface that does not protrude beyond the outer surface of the second panel member.

20. A panel unit as claimed in claim 19 wherein said second connector comprises:

(a) a cap portion and a shaft portion interconnected to said cap portion, said shaft portion with an end having an opening adapted to be interconnected to said second end of said tie member, said cap portion having an inner surface and an opposed outer surface, said inner surface of said cap portion facing said inner surface of said second panel member;

(b) a cutting element positioned beneath said inner surface of said cap portion;

whereby when said connector member is rotated to provide a connection with said tie member, said connector member is axially drawn toward said tie member and said cutting element will form a recess in an outer surface of said second panel member for receiving said cap portion, so that said cap portion does not protrude beyond said outer surface of said second panel member and said second panel member can remain in situ after said concrete has hardened.

21. A panel unit as claimed in claim 15 wherein said spacer comprises said first rod member and a second rod member and wherein said first rod member, said second rod member and said transverse tie member form a substantially rigid geometrically stable grid.

22. A panel unit as claimed in claim 21 wherein said spacer comprises a second transverse tie member secured to and extending generally parallel to said first transverse tie member and between said first rod member and said second rod member such that said first rod member, second rod member and said first and second transverse tie members form a substantially rigid geometrically stable grid.

23. A panel unit for use as part of a concrete form for a concrete wall, said panel unit comprising:

(a) first and second panel members, said panel members being spaced apart and oriented generally in a first longitudinal direction, said panel members defining a form space there between;

(b) a spacer comprising:

(i) at least one transverse tie member generally oriented in a second transverse direction that is orthogonal to said first direction, said tie member being secured to and extending between said first and second panel members, said at least one transverse tie member having a first end and an opposite second end each said end being adapted for securing said transverse tie member to a connector to mount said spacer to said first and second panel members;

(ii) first and second rod members having first portions mounted to said tie member and said first and second rod members being oriented generally in a third direction that is orthogonal to both said first and second directions, said first and second rod members being spaced apart in said second transverse direction and said first and second rods being in generally spaced, and generally parallel relation to each other, each of said first and second rod members having end portions that extend from said first portions in a fourth and fifth direction respectively that are oriented at a first angle and a second angle respectively that are between said first and third directions;

(iii) a first transverse rod member secured proximate to or at said end portion of said first and second rod members and extending generally in said second transverse direction between said first and second rod members;

(iv) a second transverse rod member secured to said end portions of each of said first and second rod members, said second transverse rod member being spaced in said first and third directions from said first transverse rod member, and said second transverse rod member extending generally in said second transverse direction between said first and second rod members;

wherein said first and second rod members, and said first and second transverse rod members define and provide there between a retaining cell, for receiving there through and retaining an elongated reinforcement member that may be oriented generally in said first or third directions.

24. A panel unit as claimed in claim 23 wherein said fourth and fifth directions are orthogonal to said second transverse direction.

25. A panel unit as claimed in claim 24, wherein said third direction is substantially vertical.

26. A panel unit as claimed in claim 23, wherein said first and second rod members have end portions that are oriented at first and second angles that are substantially the same angle.

27. A panel unit as claimed in claim 26, wherein said same angle is between 20 and 40 degrees measured from said first direction.

28. A panel unit as claimed in claim 23 wherein said at least one transverse tie member employed for securing said spacer to said first panel member and connector, comprises one of said first and second transverse rods.

29. A panel unit as claimed in claim 23, wherein each of said first and second rod members has a second end portion opposite to said first end portion, each said second end portions being oriented at a third and fourth angle respectively to said first portions of said first and second rod members, each of said second end portions extending from said first portions in a sixth and seventh directions that are oriented at a third angle and fourth angle respectively that are between said first and third directions, and wherein said spacer further comprises:

(a) a third transverse rod member secured proximate to or at said second end portion of said first and second rod members and extending generally in said second transverse direction between said first and second rod members;

(b) a fourth transverse rod member secured to said end portions of each of said first and second rod members, said third transverse rod member being spaced in said first and third directions from said fourth transverse rod member, and said fourth transverse rod member extending generally in said second transverse direction between said first and second rod members;

said first and second rod members, and said third and fourth transverse rod members configured to define and provide there between a second retaining cell, for receiving there through and retaining a generally vertically oriented reinforcement member.

30. A panel unit as claimed in claim 29, wherein said first and second retaining cells are substantially aligned in said second and third directions and spaced in said first direction to permit a reinforcement member generally oriented in said first direction to be retained in both said first and second retaining cells.

31. A panel unit as claimed in claim 29 wherein said third direction is substantially vertical.

32. A panel unit as claimed in claim 29, wherein said first and second rod members have second end portions that are each oriented at substantially the same angle to said first portions of said first and second rod members.

33. A panel unit for use as part of a concrete form for a concrete wall, said panel unit comprising:

(a) a first panel member having an inner surface and an opposed outer surface; said first panel member made from a material comprising a rigid foamed plastic strengthened with a plastic film laminated to at least said inner surface of said first panel member; said plastic film laminated to said inner surface of said first panel member having non-adhesive properties in relation to hardened concrete, said first panel member having first and second spaced apertures extending from said inner surface to said outer surface of said first panel member;

(b) a second panel member made from a material comprising a foamed plastic and said second panel being spaced apart in a transverse direction from said first panel member to define a form space between said first panel member and said second panel member, said inner surface of said first panel member facing an inner surface of said second panel member;

(c) a spacer generally being transversely positioned between said first and second panel members, said spacer holding said first and second panel members in generally transversely spaced relation to each other, said spacer comprising:

(i) first and second transverse tie members each having a first end and an opposite second end, said first ends of each of said first and second transverse tie members being adapted for securing respectively said first and second transverse tie members to said first panel with a first connector and a second connector, mounted in respective said first and second apertures of said first panel member; said first connector and said second connector being adapted to be removable from the first and second transverse tie members after said form space has been filled with concrete and said concrete has hardened;

said material of said first panel member being in a compressed state caused at least in part by interaction of said spacer and said first connector, to provide assistance in establishing a substantially rigid and geometrically stable panel unit.

34. A panel unit as claimed in claim 33 wherein the plastic film is made from polypropylene.

35. A panel unit as claimed in claim 33 wherein said first connector has a shaft portion that passes transversely through an aperture in said first panel member to engage said first end of said first transverse tie member.

36. A panel unit as claimed in claim 35 wherein said first connector comprises a flange cap portion and a shaft portion, said shaft portion having a blind opening with a cavity having a smooth inner wall extending along said shaft towards said flange cap portion, said first end of said transverse tie member having a plurality of separate circular teeth spaced from each other, said teeth having an outer diameter that is larger than the inner diameter of said threaded cavity in said shaft portion of said first connector, but smaller than the outer diameter of said shaft portion, said shaft portion being made of a material that will elastically deform to receive said teeth of said first end portion of said transverse tie member, such that when said first end of said transverse tie member is forced through said opening into said cavity, said inner wall will bind with said teeth to provide a connection that resists axial loading of said connector tending to push said shaft portion of said first connector out of said first end during filling said concrete form with unhardened concrete.

37. A panel unit as claimed in claim 36, wherein said shaft portion of said connector is made from polypropylene.

38. A panel unit as claimed in claim 36, wherein said cap portion and said shaft portion are made from a rigid plastic material.

39. A panel unit as claimed in claim 33 wherein after said form space has been filled with concrete and said concrete has hardened, said first connector, said second connector and said first panel member can be removed such that said first panel member is disconnected from said spacer.

40. A panel unit as claimed in claim 33 wherein said first panel member is made from rigid foamed polystyrene laminated with a plastic film.

41. A panel unit as claimed in claim 33 wherein said second panel member is made from extruded or molded foamed polystyrene.

42. A panel unit as claimed in claim 33 wherein said first connector comprises a shaft portion, said shaft portion having an end with an opening leading to a channel extending within said shaft, said channel being adapted to be interconnected to said first end of said first transverse tie member, wherein said channel and said first transverse tie member are configured such that when said first connector is connected to said first end of said first transverse tie member, said first end of said first transverse tie member is held in said channel of said shaft in such a position that said first panel member is held in compression by interaction of said first connector and said spacer.

43. A panel unit as claimed in claim 42 wherein said shaft portion has an inner smooth cavity that has a diameter that is less than the outer diameter of said first end of said first transverse tie member.

44. A panel unit as claimed in claim 43 wherein said first connector further comprises a cap member having a flange cap portion connected to a shaft portion, wherein when said shaft portion of said first connector is pushed onto said tie member, said first panel member is held in compression by said cap member.

* * * * *